US009163373B2

(12) United States Patent
Bradley, Sr. et al.

(10) Patent No.: US 9,163,373 B2
(45) Date of Patent: Oct. 20, 2015

(54) MULTI-RIBBED GEOTEXTILE TUBES AND SEGMENTS THEREOF

(75) Inventors: Anthony Shepherd Bradley, Sr., Valparaiso, FL (US); Anthony Shepherd Bradley, Jr., Valparaiso, FL (US)

(73) Assignee: BRADLEY INDUSTRIAL TEXTILES, INC., Valparaiso, FL (US)

( * ) Notice: Subject to any disclaimer, the term of this patent is extended or adjusted under 35 U.S.C. 154(b) by 752 days.

(21) Appl. No.: 13/323,912

(22) Filed: Dec. 13, 2011

(65) Prior Publication Data

US 2013/0048138 A1 Feb. 28, 2013

Related U.S. Application Data

(60) Provisional application No. 61/527,347, filed on Aug. 25, 2011.

(51) Int. Cl.
*F16L 11/00* (2006.01)
*E02B 3/12* (2006.01)

(52) U.S. Cl.
CPC ..... *E02B 3/127* (2013.01)

(58) Field of Classification Search
CPC ..... F16L 11/02; E02B 3/106; E02B 7/14; E02B 7/08; E02B 7/02
USPC ..... 138/120, 128, 158, 169; 405/107, 111, 405/114, 115
See application file for complete search history.

(56) References Cited

U.S. PATENT DOCUMENTS

| | | | | |
|---|---|---|---|---|
| 4,512,274 | A * | 4/1985 | Campbell et al. | 112/423 |
| 5,232,429 | A * | 8/1993 | Cizek et al. | 493/299 |
| 5,472,297 | A * | 12/1995 | Heselden | E04C 1/395 405/258.1 |
| 5,505,557 | A | 4/1996 | Bradley | |
| 5,902,070 | A | 5/1999 | Bradley | |
| 6,056,438 | A | 5/2000 | Bradley | |
| 6,186,701 | B1 | 2/2001 | Kempers | |
| 6,860,218 | B2 | 3/2005 | Eagles et al. | |
| 7,357,598 | B1 | 4/2008 | Bradley | |
| 7,891,914 | B2 | 2/2011 | Smallwood et al. | |
| 2002/0178987 | A1* | 12/2002 | Eagles et al. | 114/256 |
| 2005/0260038 | A1* | 11/2005 | Sousa Costa | 405/115 |
| 2006/0165320 | A1* | 7/2006 | Stephens | 383/117 |
| 2007/0009327 | A1* | 1/2007 | Sanguinetti | 405/115 |
| 2008/0138157 | A1* | 6/2008 | Kim | 405/107 |

(Continued)

FOREIGN PATENT DOCUMENTS

| | | |
|---|---|---|
| KR | 2009 0118296 | 11/2009 |
| WO | 97/29247 | 8/1997 |

(Continued)

OTHER PUBLICATIONS

International Search Report and Written Opinion of the ISA, issued for PCT/US2012/050056, dated Jan. 17, 2013.

*Primary Examiner* — James Hook
(74) *Attorney, Agent, or Firm* — Dority & Manning, P.A.

(57) ABSTRACT

A large scale geotextile tube includes a plurality of cylindrical geotextile segments permanently connected end-to-end via circumferential ribs. In one embodiment, each geotextile segment is formed of the sheet of geotextile fabric that has an overlapping region that measures at least 5% of the elongation at break length of the sheet and permanently connected with at least one transverse rib to form an axial closure.

36 Claims, 10 Drawing Sheets

(56) References Cited

U.S. PATENT DOCUMENTS

| | | | | |
|---|---|---|---|---|
| 2008/0279634 | A1* | 11/2008 | Heselden | E01F 8/025 405/114 |
| 2011/0206458 | A1* | 8/2011 | Jones et al. | 405/19 |
| 2014/0076482 | A1* | 3/2014 | Kunk et al. | 156/185 |

FOREIGN PATENT DOCUMENTS

| | | |
|---|---|---|
| WO | 2004 061241 | 7/2004 |
| WO | 2007 114580 | 10/2007 |

* cited by examiner

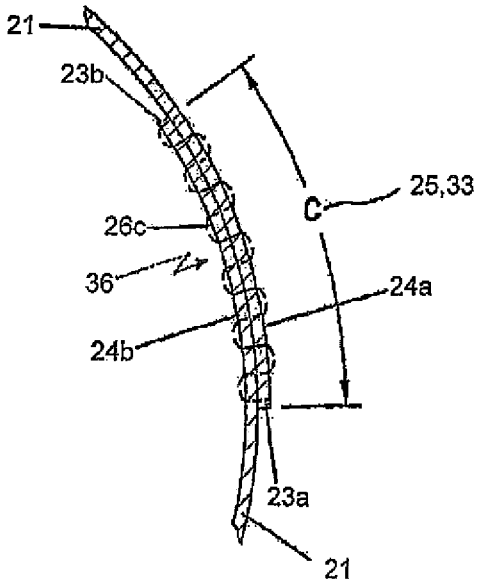
FIG. –2a–
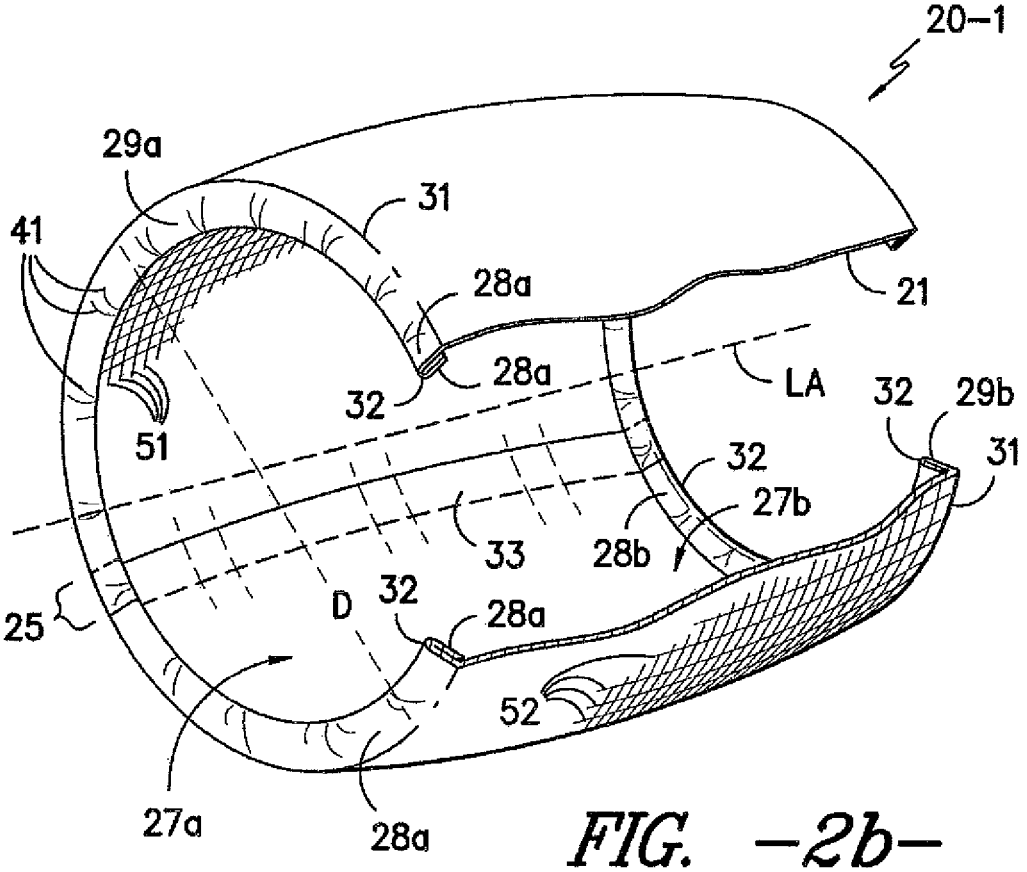
FIG. –2b–

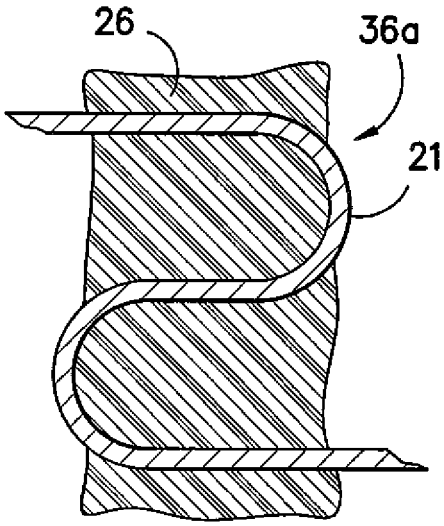
FIG. –2d
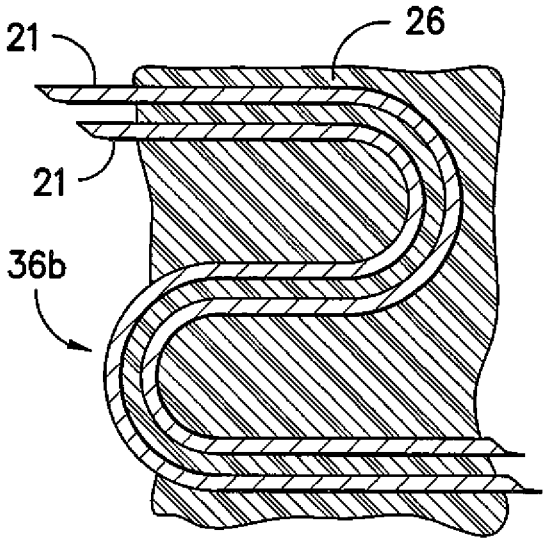
FIG. –2e–
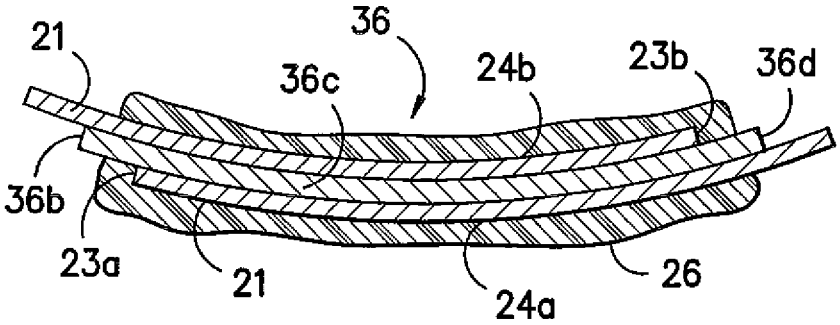
FIG. –2f–

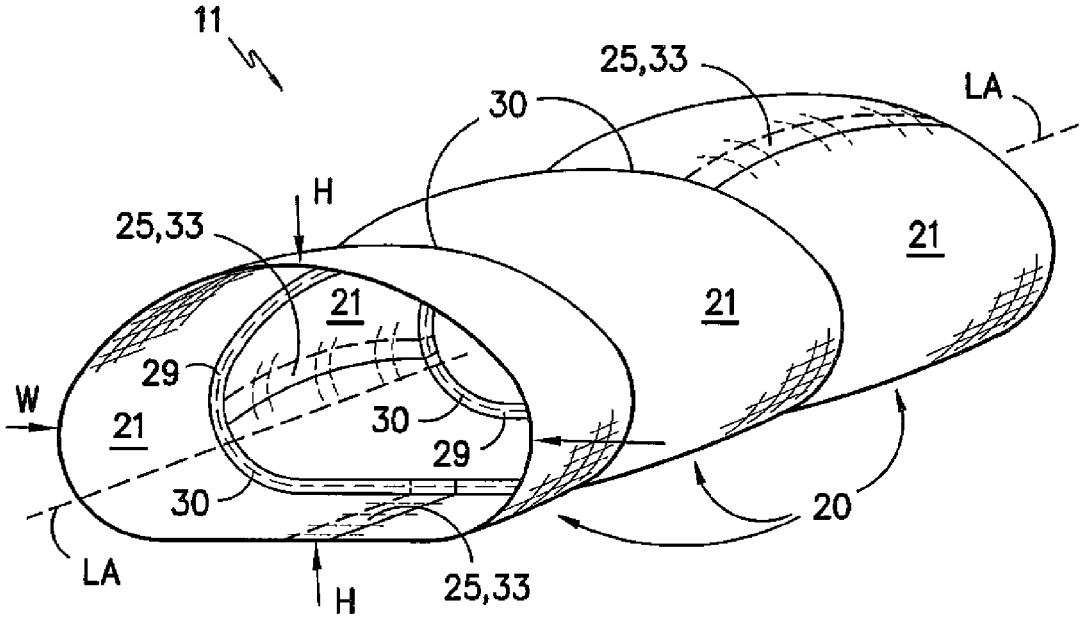
FIG. –4–
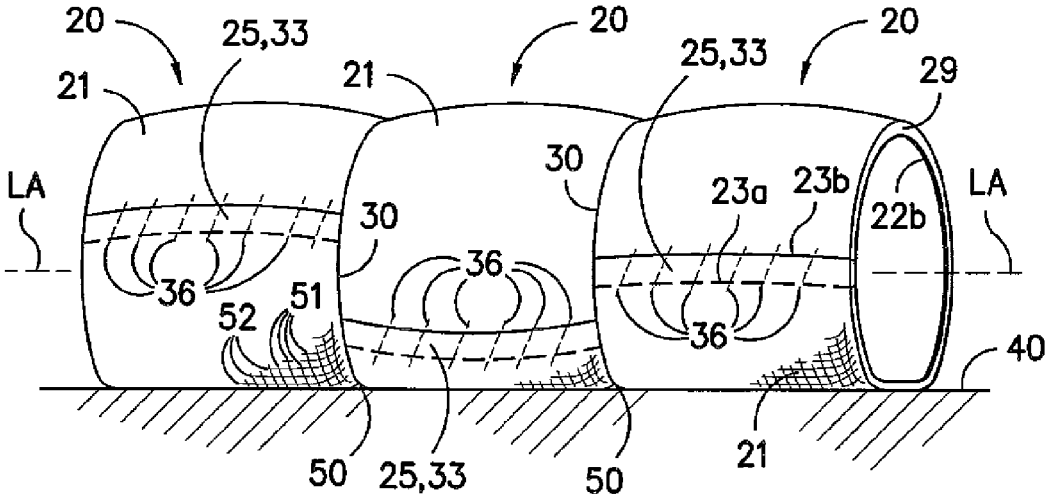
FIG. –5–

MULTI-RIBBED GEOTEXTILE TUBES AND SEGMENTS THEREOF

CROSS-REFERENCE TO RELATED APPLICATIONS

The present application claims priority to U.S. Provisional Patent Application Ser. No. 61/527,347, filed Aug. 25, 2011.

STATEMENT REGARDING FEDERALLY SPONSORED RESEARCH OR DEVELOPMENT

N/A

BACKGROUND OF THE INVENTION

As described in U.S. Pat. No. 6,186,701 to Kempers for example, which is hereby incorporated herein for all purposes by this reference, geotextile tubes are elongate flexible containers made of textile fabric and have been used as the core or base of a dam, a quay, a bank reinforcement, at the bed of a waterway, etc. and for dewatering sludge. Such containers conventionally include stitching extending in the longitudinal direction of the container and mutually connecting facing edges of the textile fabric that form longitudinally extending seams. Because of the many tons of materials in slurry form that are pumped under pressure into geotextile tubes during their deployments alongside shorelines and other areas for which erosion protection is desired, enormous pressure can develop inside these tubes. Structural failure of these geotextile tubes typically occurs (in the absence of flaws in the geotextile fabric) where the longitudinal seams are joining different sections of the geotextile fabric. While it theoretically is possible to weave a geotextile tube using a circular loom and thus avoid such longitudinally extending seams, this fabrication process is not economical for geotextile tubes having circumferences on the order of more than about six meters. Moreover, because no more than about 45,000 pounds of cargo can be carried by truck and no more than about 20,000 pounds can be carried by forklift, the sizes of these geotextile tubes has been limited by their overall bulk and weight due to the need to transport the geotextile tubes over long distances to locations where they are to be deployed.

OBJECTS AND SUMMARY OF THE INVENTION

It therefore is a principal object of the present invention to provide an improved geotextile tube having a circumference on the order of at least six meters while having seams joining different sections of geotextile fabric.

Additional objects and advantages of the invention will be set forth in part in the description that follows, and in part will be obvious from the description, or may be learned by practice of the invention. The objects and advantages of the invention may be realized and attained by means of the instrumentalities and combinations particularly pointed out in the appended claims.

To achieve at least one of the objects and in accordance with the purpose of the invention, as embodied and broadly described herein, a geotextile tube having a circumference on the order of at least six meters comprises a plurality of cylindrical geotextile segments. One embodiment of each geotextile segment desirably is formed by overlapping the free edge sections of the opposite ends of a sheet of geotextile fabric of a given length to form an overlapping region that also determines the circumference of the geotextile segment and defines an axial closure of the geotextile segment. Forming each geotextile segment with only a single axial closure in this way eliminates the need for multiple axial seams that otherwise would be required in order to construct a conventional geotextile tube having a very large diameter. Each sheet of geotextile fabric from which geotextile segments and tubes are made is rated for a particular percentage elongation that can occur prior to the fibers of the fabric breaking and the fabric tearing. Once the size of the sheet of geotextile fabric is known, this percentage can be expressed as a given length of the sheet of geotextile fabric. This length is known as the "elongation at break" length of the sheet of geotextile fabric of given length.

In accordance with one aspect of the present invention, the linear distance of the overlapping free edge sections of the opposite ends of a sheet of geotextile fabric of a given length measured in the circumferential direction of the geotextile segment desirably exceeds about 3% of the elongation at break length of the sheet of geotextile fabric. Because the overlapping region of each geotextile segment of the geotextile tube extends beyond the elongation at break length of the sheet of geotextile fabric, it is as if the geotextile tube does not have any seams that extend axially along the length of the geotextile tube. This result occurs because any expansion of the fabric under pressure during the filling thereof will cause the fabric to fail at a single thickness of the fabric rather than where there are two overlapping sections of fabric in each of the overlapping regions of the many geotextile segments that are joined together to compose the geotextile tube. Thus, the circumferentially overlapping free ends of the sheet of geotextile fabric essentially double the magnitude of the elongation at break force at the overlapping region of the cylindrical geotextile segment. By eliminating bursting of the conventional axial seams of the conventionally constructed geotextile tube, this aspect of the present invention facilitates being able to construct geotextile tubes of very large diameters without having to use circular looms to produce the geotextile tube.

Another aspect of the present invention derives from being able to construct lengthy geotextile tubes of very large diameters on the order of many dozens of feet that when filled with liquids and solids nonetheless have desirable height to width ratios that are larger than height to width ratios of conventional geotextile tubes of comparable diameter, length and fabric composition. Each geotextile segment desirably is defined by a diameter of each opposite open end and an axial length that extends longitudinally between the opposite open ends of the geotextile segment. One of the open ends of one geotextile segment can be permanently connected to one of the open ends of another geotextile segment to form a section of a geotextile tube that measures in length a distance that is about equal the sum of the axial lengths of the two geotextile segments. Each geotextile tube desirably is formed by permanently joining a plurality of geotextile segments end-to-end so that the combined axial lengths of the geotextile segments determines the overall axial length of the geotextile tube formed from such connected geotextile segments.

To effect these end-to-end connections, each open end of each geotextile segment desirably defines a joining flange that is permanently connected to an opposing joining flange of another geotextile segment to form a circumferentially extending rib of the geotextile tube. The desired relative stiffness of each of these circumferential ribs depends on the type of geotextile fabric composing each of the joined geotextile segments and increases proportionally to the number of thicknesses of the geotextile fabric material forming the circumferential rib. The axial spacing between adjacent circumferential ribs down the length of the geotextile tube desirably can depend on the dimensions of the geotextile segments that are used to form the geotextile tube, the characteristics of the geotextile fabric from which the geotextile segments are made and the relative stiffness of the circumferential ribs. The axial spacing between adjacent circumferential ribs also can depend on the whether the circumferential ribs are configured to lie in a direction that is normal to the central longitudinal axis of the geotextile segment or disposed at other than ninety degrees with respect to such central longitudinal axis of the geotextile segment. The axial spacing of the circumferential ribs along the length of the geotextile tube also can depend on the location where a particular geotextile segment will be deployed during use of the geotextile tube, and the type, weight and volume of fill material to be placed into the geotextile tube.

The axial lengths of the geotextile segments in a given geotextile tube can be uniform over the entire length of the geotextile tube or can vary. The variance can depend on a number of factors, whether taken individually or collectively with one or more other factors. The axial lengths of the geotextile segments in a given geotextile tube can be varied over the entire length of the geotextile tube with geotextile segments of different axial lengths being used at different portions of the overall geotextile tube. The particular axial length of a particular geotextile segment can be chosen based on one or more of a number of variables, which include but are not limited to the following: the diameter of the geotextile segment, the composition of the geotextile fabric that forms the geotextile segment, the elongation at break length of the geotextile segment, whether the circumferential ribs are configured to lie in a direction that is normal to the central longitudinal axis of the geotextile segment or disposed at other than ninety degrees with respect to such central longitudinal axis of the geotextile segment, the location where a particular geotextile segment will be deployed during use of the geotextile tube, and the type, weight and volume of fill material to be placed into the geotextile tube.

With respect to the disposition of the central longitudinal axis of each geotextile segment, each of the elongation direction of the axial closure and the orientation of the circumferential ribs can be varied to suit one or more of the various factors noted above, thus giving the designer of the geotextile tube ample latitude to suit the varied and unusual environmental conditions that may be encountered in practice.

The accompanying drawings, which are incorporated in and constitute a part of this specification, illustrate at least one presently preferred embodiment of the invention as well as some alternative embodiments. These drawings, together with the description, serve to explain the principles of the invention but by no means are intended to be exhaustive of all of the possible manifestations of the invention.

BRIEF DESCRIPTION OF THE DRAWINGS

FIG. 2*a* schematically depicts a partial cross-sectional view taken in the direction of arrows 2*a*-2*a* in FIG. 2.

FIG. 2*b* schematically depicts a partially cut-away perspective view taken in the direction of arrows 2*b*-2*b* in FIG. 2.

FIG. 2*d* schematically depicts a partial cross-sectional view taken in the direction of arrows 2*d*-2*d* in FIG. 2*c*.

FIG. 2*e* schematically depicts a partial cross-sectional view taken in the direction of arrows 2*e*-2*e* in FIG. 2*c*.

FIG. 2*f* schematically depicts a partial cross-sectional view taken in the direction of arrows 2*f*-2*f* in FIG. 2*c*.

FIG. 4 schematically depicts in an elevated perspective view looking into the open end of an embodiment of a geotextile tube including a plurality of cylindrical geotextile segments.

FIG. 5 schematically depicts in an elevated perspective view, three connected cylindrical geotextile segments composing an embodiment of a geotextile tube in which the axial closure of each geotextile segment elongates between the circumferential ribs in a direction that is substantially parallel to the central longitudinal axis of each geotextile segment but not in alignment with the elongation directions of the axial closures of the two adjacent geotextile segments, and the end seams joining adjacent geotextile segments to form each circumferential rib are disposed at a right angle with respect to the central longitudinal axis of each geotextile segment.

FIG. 9 schematically depicts in an elevated perspective view, three connected cylindrical geotextile segments composing an embodiment of a geotextile tube in which the axial closure of each segment elongates between the circumferential ribs in a direction that is parallel to the central longitudinal axis of each segment but not in alignment with the elongation directions of the axial closures of the two adjacent segments, the end seams joining adjacent segments to form each circumferential rib are disposed at a right angle with respect to the central longitudinal axis of each segment, and each axial closure is fastened by a plurality of spaced apart transverse ribs.

FIG. 10 schematically depicts in an elevated perspective view, three connected cylindrical geotextile segments composing an embodiment of a geotextile tube in which the axial closure of each geotextile segment elongates between the circumferential ribs in a direction that is parallel to the central longitudinal axis of each geotextile segment but not in alignment with the elongation directions of the axial closures of the two adjacent geotextile segments, the end seams joining adjacent segments to form each circumferential rib are disposed at a right angle with respect to the central longitudinal axis of each geotextile segment, and each axial closure is fastened by a plurality of axially spaced apart, transverse ribs.

FIG. 11 schematically depicts in an elevated perspective view, three geotextile segments being constructed into an embodiment of a geotextile tube in which the axial closure of each geotextile segment elongates between the circumferential ribs in a direction that is disposed other than parallel with respect to the central longitudinal axis of each geotextile segment, and the end seams joining adjacent geotextile segments to form each circumferential rib are disposed at other than a right angle with respect to a line that is normal to the central longitudinal axis of each geotextile segment.

FIG. 12 schematically depicts in an elevated perspective view, three joined geotextile segments being constructed into an embodiment of a geotextile tube in which the end seams joining adjacent geotextile segments to form each circumferential rib are disposed at a right angle with respect to the central longitudinal axis of each geotextile segment, the axial closure of each geotextile segment elongates between the circumferential ribs in a direction that is disposed at other than a right angle with respect to the central longitudinal axis of each geotextile segment, and the cumulative shape formed by the successive axial closures of the geotextile segments is helical.

DETAILED DESCRIPTION OF PRESENTLY PREFERRED EMBODIMENTS

Reference now will be made in detail to presently preferred embodiments of the invention, examples of which are illustrated in the accompanying drawings. Each example is provided by way of explanation of the invention, which is not restricted to the specifics of the examples. In fact, it will be apparent to those skilled in the art that various modifications and variations can be made in the present invention without departing from the scope or spirit of the invention. For instance, features illustrated or described as part of one embodiment, can be used on another embodiment to yield a still further embodiment. Thus, it is intended that the present invention cover such modifications and variations as come within the scope of the appended claims and their equivalents. The same numerals are assigned to the same components throughout the drawings and description.

Figure 1:
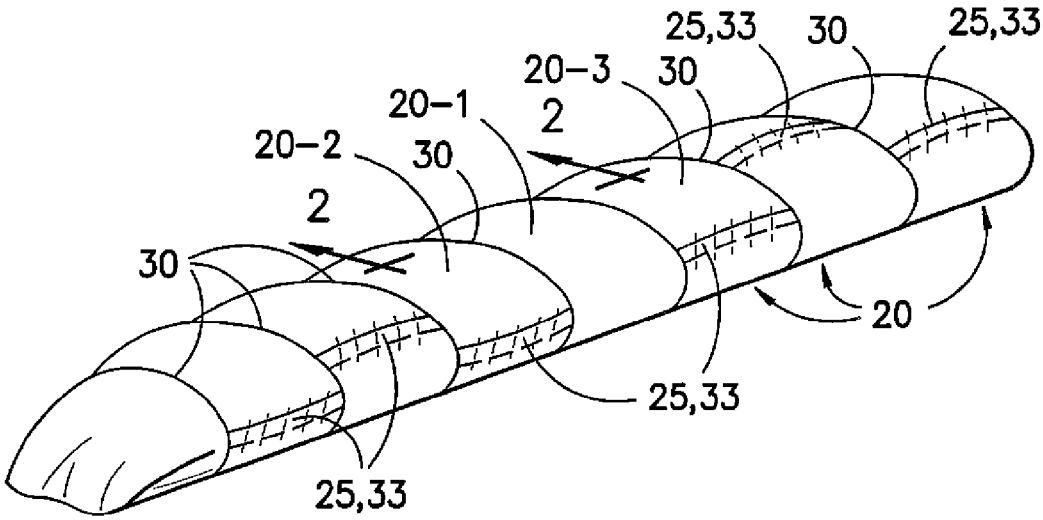
FIG. 1 schematically depicts in an elevated perspective view, an embodiment of a geotextile tube including a plurality of cylindrical geotextile segments.

One presently preferred embodiment of a large scale, hollow geotextile tube is schematically shown in FIG. 1 and is designated generally by the numeral 11. As schematically shown therein, the hollow geotextile tube comprises a plurality of hollow geotextile segments, each separate hollow geotextile segment being designated generally by the numeral 20. Each of the hollow geotextile segments 20 can be identically constructed or vary in certain details in its construction. Moreover, each open end of each of the hollow geotextile segments 20 can be connected to the open end of each adjacent hollow geotextile segment 20 in the identical manner. However, as explained more fully herein, the manner of such connection between adjacent hollow geotextile segments 20 can vary in certain details of its connection from one connection to the next.

Various constructions of the hollow geotextile segments 20 now will be described beginning with reference to FIG. 3. As schematically shown therein, the main body of a hollow geotextile segment 20 is provided by a sheet 21 of geotextile fabric that desirably is formed as a continuous sheet 21 of geotextile fabric that is defined in part by an elongation at break rating that is indicative of when the fabric under stress has been strained to the point that it begins to tear. The elongation at break rating of the geotextile fabric is often expressed as a percentage of the length of the fabric in question, and for a given length of fabric is conveniently expressed as the distance that the fabric can be stretched (elongated) before the fabric's fibers begin to break and the fabric begins to tear. The elongation at break rating of the geotextile fabrics presently contemplated for the segments 20 and tubes 11 herein can be as much as 15% to 20% of the unstretched length of the fabric. Thus, for a sheet 21 of geotextile fabric having a length measuring one hundred meters unstretched, the elongation at break rating could be as much as 15 m to 20 m.

The geotextile fabric desirably can be formed by being woven from synthetic fibers such as nylon, polypropylene, polyester, polyethylene or any combination of the foregoing fibers. Among the most widely used materials are polyesters laminated or coated with polyvinyl chloride (PVC), and woven fiberglass coated with polytetrafluoroethylene (PTFE). Other materials would include geosynthetics, which can be woven, non-woven, geo-composites, grids, scrims, non-woven fabrics that are needled punched into woven fabrics or into grids, and the fabrics can be coated to impart desired properties, uncoated, water permeable, non-permeable to water or have a combination of permeable and non-permeable regions.

If a fabric ruptures, it generally will do so by tearing, which can occur when a local stress concentration causes one yarn to break, which thereby increases the stress on remaining yarns. If the remaining yarns have essentially the same rupture strength (aka, tensile strength) as the first torn yarn and the local stress concentration persists, this condition can cause the remaining yarns to tear in a sort of snowball effect.

Each resulting sheet 21 of the geotextile fabric desirably is formed such that it can withstand forces appropriate to the application for which the resulting large scale geotextile tube 11 is intended to be used. The modular construction of geotextile tubes 11 from a plurality of geotextile segments 20 afforded by the present invention permits the designer of geotextile tubes to assign fabric of different tensile strengths to different segments 20 or groups of segments 20 intended for disposition in environments of differing conditions of stress. Thus, for some geotextile segments 20 geotextile fabric having a rupture or tear strength of 200 pounds per square inch will suffice for a large scale geotextile tube 11 intended for some applications. However, other applications will require the sheet 21 of geotextile fabric to withstand on the order of 1,000 pounds per square inch without rupturing or tearing. The sheet 21 of geotextile fabric can be either permeable or non-permeable to water, as the application for the large scale geotextile tube 11 demands.

Figure 3:
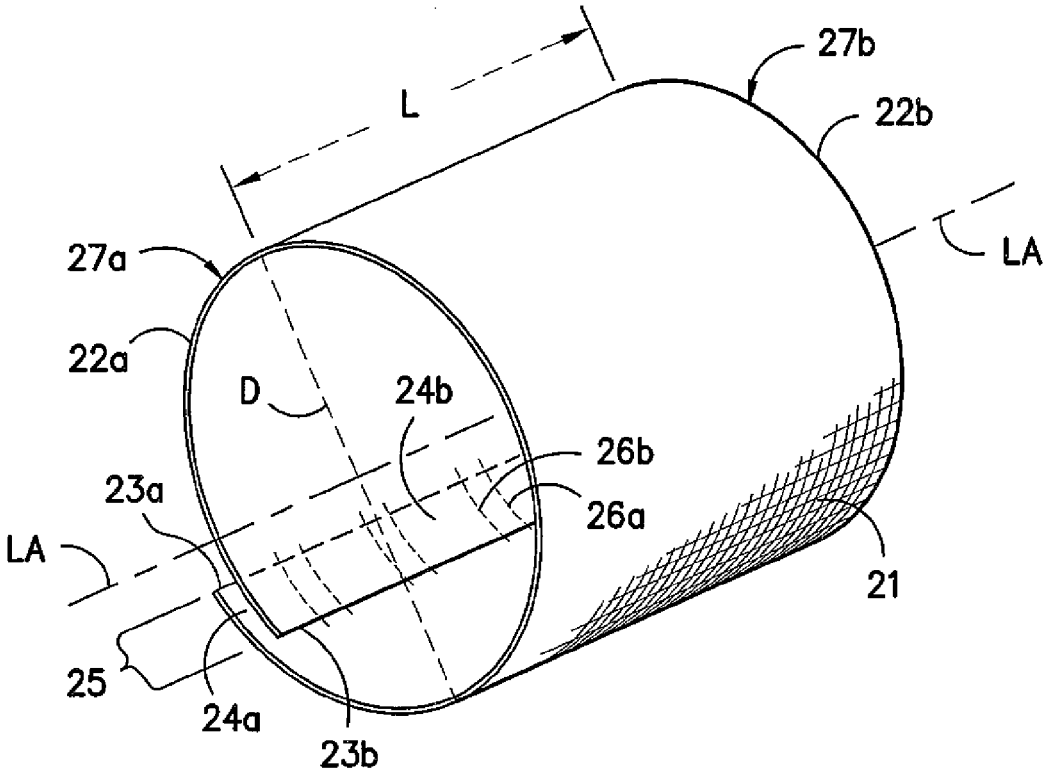
FIG. 3 schematically depicts in an elevated perspective view, construction of an embodiment of a cylindrical geotextile segment of a geotextile tube.

As schematically shown in FIG. 3, the sheet 21 of geotextile fabric desirably is defined by opposed long side edges 22*a*, 22*b* disposed generally parallel to each other and by opposed short side edges 23*a*, 23*b* disposed generally parallel to each other. Each of the long side edges 22*a*, 22*b* is configured so as to be longer in length than each of the short side edges 23*a*, 23*b*. However, in constructing geotextile segments 20 such as those depicted in each of FIGS. 7, 8, 11 and 12 for example, it might be desired to cut each of the short side edges 23*a*, 23*b* at a bias with respect to the opposed long side edges 22*a*, 22*b*.

As schematically shown in FIGS. 2*b* and 3 for example, the sheet 21 of geotextile fabric used to form each geotextile segment 20 can be composed of warp yarns 51 and weft yarns 52 that exhibit the same tensile strength. Typically, if one exhibits higher tensile strength than the other, it will be the warp yarns 51 that have the greater tensile strength. Though the distances between yarns is exaggerated in FIGS. 2*b* and 3 for purposes of ease of illustration, the warp yarns 51 of the sheet 21 of geotextile fabric desirably will extend generally parallel to each other in the circumferential direction of the cylindrically shaped geotextile segment 20, and the weft (or fill) yarns 52 of the sheet 21 of geotextile fabric desirably will extend generally parallel to each other and to the longitudinal axis LA in the axial direction of the cylindrically shaped geotextile segment 20 and normal to the warp yarns 51. However, it also is contemplated that the sheet 21 of geotextile fabric can be cut so that when formed into the cylindrical shape of the geotextile segment 20, the extension direction of each of the warp yarns 51 and weft yarns 52 will be disposed at other than a right angle or parallel to the direction of the central longitudinal axis of the geotextile segment 20.

The length of the sheet 21 depicted schematically in FIG. 3 is a distance l (not shown), which equals the distance between the opposed short side edges 23*a*, 23*b* of the sheet 21 of geotextile fabric. As described below, this length (distance l, not shown) of the sheet 21 of geotextile fabric depicted schematically in FIG. 3 becomes the circumference (minus the overlapping region 25) of the circumferentially extending wall of each hollow geotextile segment 20. As such, it is desirable that the warp yarns 51 of the sheet 21 of geotextile fabric should elongate to form this length (distance l, not shown) of the sheet 21 of geotextile fabric. Moreover, these warp yarns of the sheet 21 of geotextile fabric desirably will have relatively higher tensile strength than the weft yarns of the fabric.

As schematically shown in FIG. 3, a first narrow end section 24*a* of the sheet 21 of geotextile fabric terminates in a first one of the short side edges 23*a*, and a second narrow end section 24*b* of the sheet 21 of geotextile fabric terminates in a second one of the short side edges 23*b*. As is typical of some embodiments of the present invention schematically shown in FIG. 3, the first narrow end section 24*a* of the sheet 21 of geotextile fabric is overlapped on the second narrow end section 24*b* of the sheet 21 of geotextile fabric to define what will become an overlapping region 25 of the hollow geotextile segment 20 and capable of forming the hollow geotextile segment 20 into a continuous cylindrical shape having a central longitudinal axis LA (indicated by the chain-dashed line in FIG. 3). Moreover, it is just as correct to say that the second narrow end section 24*b* of the sheet 21 of geotextile fabric is overlapped on the first narrow end section 24*a* of the sheet 21 of geotextile fabric to define what will become an overlapping region 25 of the hollow geotextile segment 20. In the enlarged schematic view shown in FIG. 2*a*, the overlapping region 25 of the hollow geotextile segment 20 is also indicated by the letter C, which also is the circumferential length of each of the respective first and second narrow end sections 24*a*, 24*b* of the sheet 21 of geotextile fabric.

As schematically shown in FIG. 3, an imaginary line connecting the shortest distance (indicated as L in FIG. 3) between the first open end 27*a* and the second open end 27*b* in the overlapping region 25 defines the elongation direction of the axial closure 33 that is formed by the connected first narrow end section 24*a* and second narrow end section 24*b* of the sheet 21 of geotextile fabric. The elongation direction of the axial closure 33 schematically shown in FIG. 3 is disposed parallel to the central longitudinal axis LA of the geotextile segment 20. This parallel disposition of the elongation direction of the axial closure 33 is also schematically shown in FIGS. 1, 2, 2*b*, 2*c*, 4, 5, 6, 9 and 10. However, as schematically shown in FIGS. 7, 8, 11 and 12 for example, the elongation direction of the axial closure 33 desirably can be disposed at an angle β that is not parallel to the central longitudinal axis LA of the geotextile segment 20.

As schematically shown in FIG. 11 for example, the angle β that relates the elongation direction of the axial closure 33 with respect to the central longitudinal axis LA of the geotextile segment 20 desirably can be greater than 45 degrees for some applications. Accordingly, for such applications, the designer of the geotextile tube 11 may deem it desirable for the elongation direction of the axial closure 33 for at least some of the geotextile segments 20 to be closer to being normal to the central longitudinal axis LA than parallel to the central longitudinal axis LA.

In accordance with one aspect of an embodiment of the present invention, the circumferential extent (measured in the direction in which the long sides edges 22*a*, 22*b* extend), of the overlapping region 25 desirably is defined by a distance that is greater than 3% (0.03 expressed as a fraction) of the elongation at break rating distance of the sheet 21 of geotextile fabric. It is particularly desirable for the overlapping region 25 desirably to be defined by a distance that is greater than 4% (0.04 expressed as a fraction) of the elongation at break rating distance of the sheet 21 of geotextile fabric. It is even more particularly desirable for the overlapping region 25 desirably to be defined by a distance that is greater than 5% (0.05 expressed as a fraction) of the elongation at break rating distance of the sheet 21 of geotextile fabric.

As schematically shown in FIG. 3, if the sheet 21 of geotextile fabric being made into a hollow geotextile segment 20 has a length F (not shown) that measures one hundred (100) meters between the short side edges 23*a*, 23*b* and has an elongation at break rating of 10%, which means in this example a distance of ten (10) meters, then the length in the circumferential direction of each of the first and second narrow end sections 24*a*, 24*b* of the sheet 21 of geotextile fabric (and thus the overlapping region 25 of the hollow geotextile segment 20) desirably can measure at least about one half meter (10 m×0.05=0.5 m). And so as schematically shown in FIG. 2*b* or example, once the overlapping region 25 is formed and before the hollow geotextile segment 20 is filled with liquids and solids, the hollow geotextile segment 20 is defined by a diameter D that is substantially uniform over the length of the geotextile segment measured along the length of the central longitudinal axis LA (FIG. 3).

While the above way of determining the length of the overlapping region 25 is satisfactory when the circumference of the geotextile segment is on the order of 100 meters, geotextile segments with smaller diameters desirably should account for the fact that the overlapping region 25 can be subtracted from the length of the sheet of fabric to allow for the fact that the overlapping region 25 of the geotextile segment 20 does not stretch to the same extent as the remainder of the sheet 21 of geotextile fabric due to the double thickness of the sheet 21 of geotextile fabric in the overlapping region 25. Accordingly, referring to FIG. 2*a* where C is denoted and FIG. 3 where D is denoted, it is true that the distance l (not identified in FIG. 3) between the opposed short side edges 23*a*, 23*b* of the sheet 21 of geotextile fabric equals pi (π) times (×) D plus (+) C, which can be expressed in the following equation: $l=\pi\times D+C$. If the elongation at break rating of the sheet 21 of fabric in FIG. 3 is expressed as a fraction 0.05 in this example and designated by K, then it also is true that C is at least equal to one twentieth of K (expressed as a fraction) times the distance l, which can be expressed in the following equation: $C=0.05\times K\times l$. Thus, there are now the following two equations:

(1) $C=l-\pi D$ and (2) $C=0.05\ Kl$. Solving these two equations for C expressed as a function of the geotextile segment's desired diameter D and the elongation at break rating K (expressed as a fraction) of the sheet 21 of geotextile fabric yields the following relation: $C=(0.05\times K\times\pi\times D)/(1-0.05\times K)$. This is the type of relation (apart form determining what fraction, i.e., 0.03 or 0.04 or 0.05 or some greater fraction) that can be used to determine the distance C of the overlapping region 25 of the geotextile segment 20 having a diameter D, but is especially to be used when the diameter D of the geotextile segments is on the order of five meters or less.

Each of the geotextile segments has its first narrow end section of the sheet of geotextile fabric being permanently connected to the second narrow end section of the sheet of geotextile fabric so that the sheet of geotextile fabric is permanently connected to itself to form an axial closure that enables the geotextile segment to take on its cylindrical shape. In theory at least, if the area of the overlapping region 25 is large enough (that is if the magnitude of C as shown in FIG. 2*a* multiplied by the circumferential arc is great enough) and the load of the tube's fill material is heavy enough and disposed on top of the overlapping region 25, then no mechanism other than the weight of the fill material on top of the overlapping region 25 is needed to secure the first narrow end section 24*a* of the sheet 21 of geotextile fabric to the second narrow end section 24*b* of the sheet 21 of geotextile fabric so that the sheet 21 of geotextile fabric is permanently connected to itself to form an axial closure 33 that enables the geotextile segment 20 to take on its cylindrical shape. However, in practice, too much geotextile material would need to be devoted to the overlapping region 25 for the weights and sizes of the circumferential arcs that are likely to be encountered for most applications. Accordingly, two more practically applicable examples of implementing this axial closure now will be described. Each of these ways involves the formation of a so-called rib that is constructed in a manner rendering such rib, whether axially extending or transversely extending, with greater tensile strength than each of the geotextile fabric and the warp yarns of same, which warp yarns 51 generally are presumed for purposes of this exemplary discussion to be stronger than the weft yarns 52 of the geotextile fabric.

Figure 2:
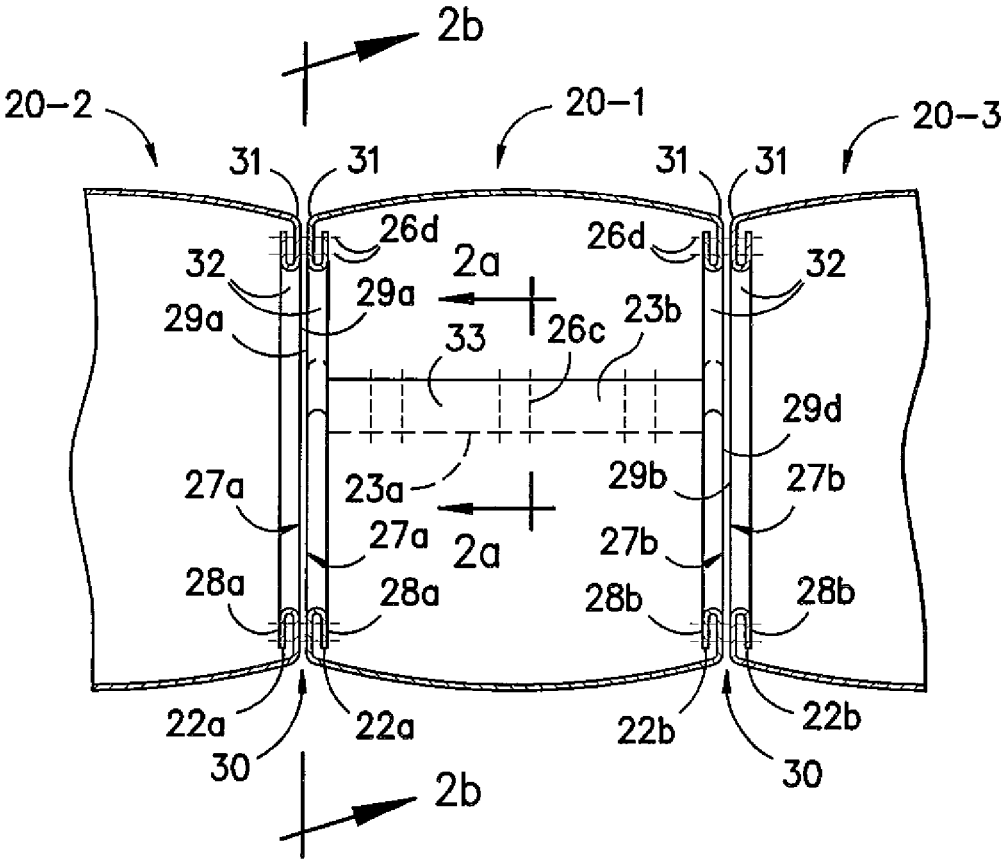
FIG. 2 schematically depicts a partial cross-sectional view taken in the direction of arrows 2-2 in FIG. 1.
Figure 2C:
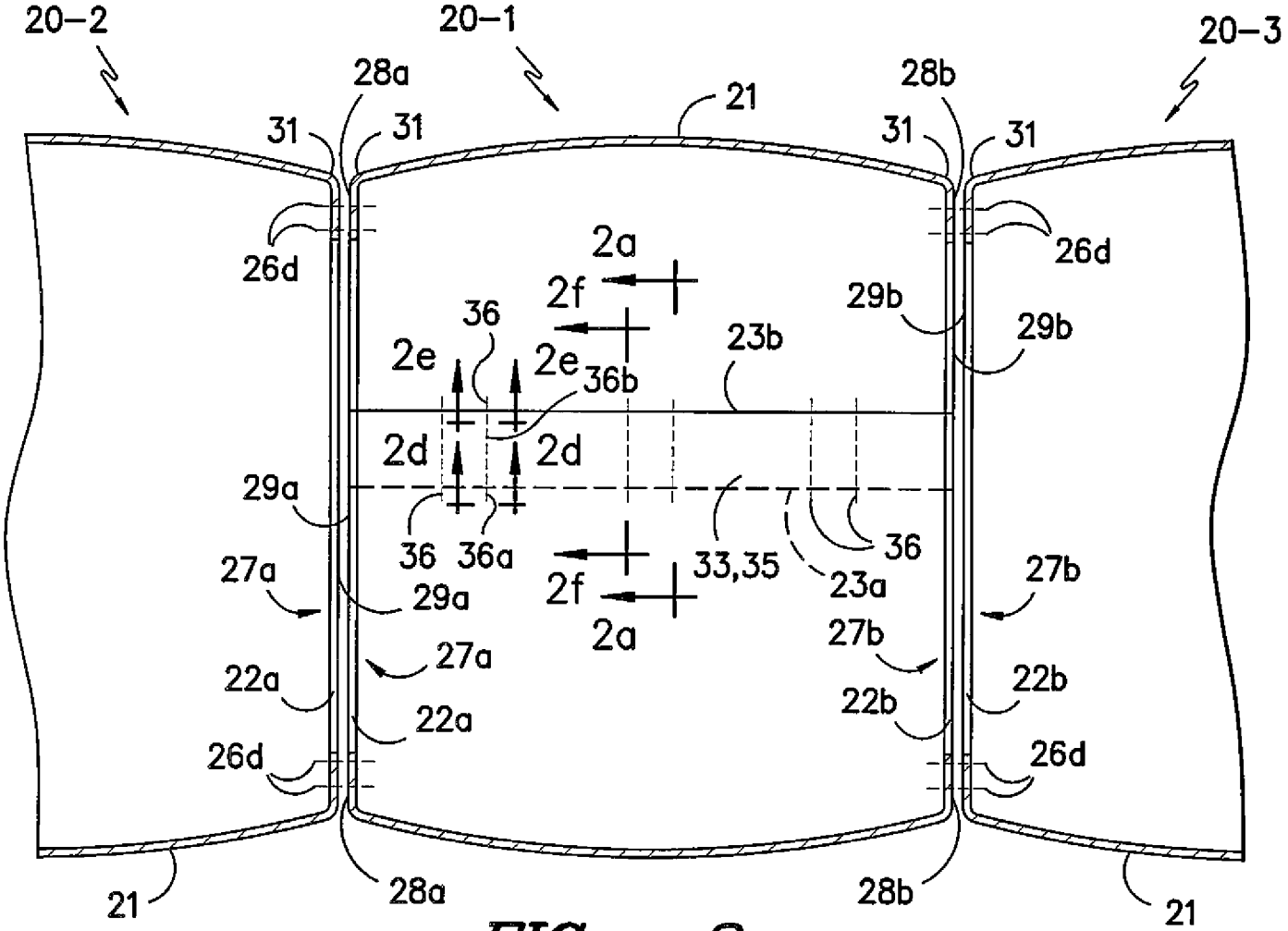
FIG. 2*c* schematically depicts a partial cross-sectional view of an alternative embodiment taken in the direction of arrows 2-2 in FIG. 1.
Figure 2G:
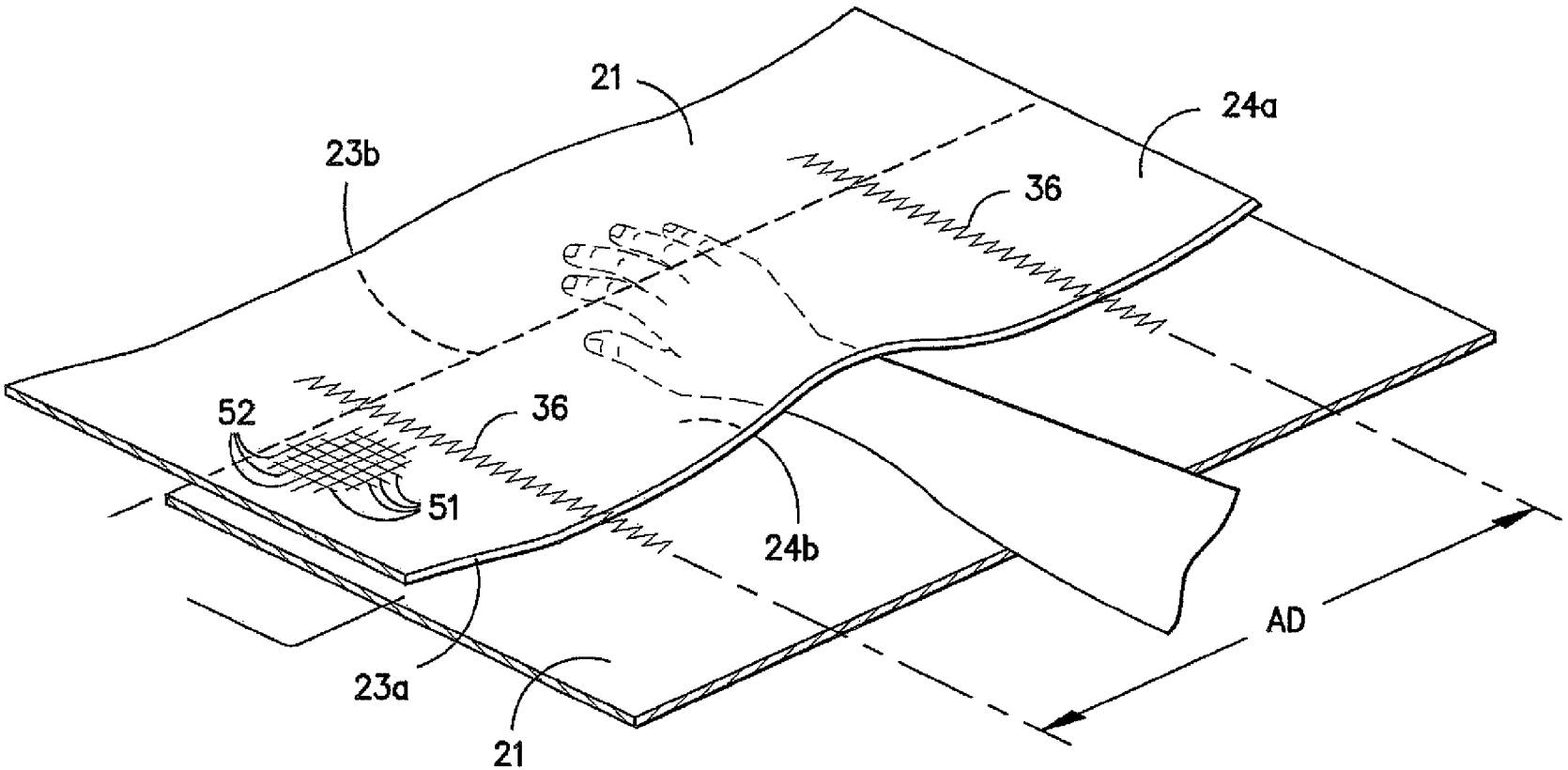
FIG. 2*g* schematically depicts in an elevated perspective view, a partial section of an embodiment of the axial closure of a cylindrical geotextile segment of a geotextile tube.

As schematically shown in FIGS. 2*a*, 2*g* and 3 for example, the first narrow end section 24*a* of the sheet 21 of geotextile fabric desirably is permanently connected to the second narrow end section 24*b* of the sheet 21 of geotextile fabric so that the sheet 21 of geotextile fabric is permanently connected to itself in the overlapping region 25 to form an axial closure 33. As schematically shown in FIGS. 2*g* and 3, at least a first transverse rib 36 is disposed transversely across the overlapping region 25 so that the transverse rib 36 permanently connects the sheet 21 of geotextile fabric to itself in the overlapping region 25 to form the axial closure 33. Desirably, at least one transverse rib 36 extends across the overlapping region 25 and transversely across at least one of the short side edges 23*a*, 23*b* of the sheet 21 of geotextile fabric to connect the first narrow end section 24*a* of the sheet 21 of geotextile fabric permanently to the second narrow end section 24*b* of the sheet 21 of geotextile fabric. More desirably, the transverse rib 36 extends across the overlapping region 25 and transversely across both of the short side edges 23*a*, 23*b* of the sheet 21 of geotextile fabric to connect the first narrow end section 24*a* of the sheet 21 of geotextile fabric permanently to the second narrow end section 24*b* of the sheet 21 of geotextile fabric.

As schematically shown in FIGS. 2*g* and 3, at least a first transverse rib 36 desirably is disposed in the overlapping region 25 to extend transversely with respect to each of the short side edges 23*a*, 23*b* of the sheet 21 of geotextile fabric. Indeed, a plurality of transverse ribs 36 desirably can be employed to permanently connect the first narrow end section 24*a* of the sheet 21 of geotextile fabric to the second narrow end section 24*b* of the sheet 21 of geotextile fabric in the overlapping region 25. Thus, as schematically shown in FIGS. 2*a*, 2*g*, 3 and 9, at least a second transverse rib 36 desirably is disposed in the overlapping region 25 to extend transversely with respect to the short side edges 23*a*, 23*b* of the sheet 21 of geotextile fabric. As schematically shown in FIG. 2*g* for example, each of the first and second transverse ribs 36 is spaced apart from each other in the axial direction by an axial distance AD. The number of transverse ribs 36, which is inversely proportional to the spacing (axial distance AD) between adjacent transverse ribs 36, depends on the desired strength required by the particular application. However, the axial distance AD desirably is less than or at least equal to the elongation at break distance of the sheet 21 of geotextile fabric and alternatively is desirably less than or at least equal to the elongation at break distance of the weft yarns 52 of the sheet 21 of geotextile fabric.

As schematically shown in FIGS. 2*g* and 9 for example, each of the first and second transverse ribs 36 is elongating in a direction that is substantially parallel to the direction of elongation of the warp yarns 51 and substantially normal to the direction of the weft yarns 52. As schematically shown in FIG. 5 for example, each of the first and second transverse ribs 36 is elongating in a direction that is not substantially parallel to the direction of elongation of the warp yarns 51 and not substantially normal to the direction of the weft yarns 52. As schematically shown in FIG. 10, a plurality of transverse ribs 36 desirably can be disposed in the overlapping region 25 to extend transversely with respect to the short side edges 23*a*, 23*b* of the sheet 21 of geotextile fabric.

Each of these transverse ribs 36 that permanently connects the two opposite narrow end sections 24*a*, 24*b* of the sheet 21 of geotextile fabric to themselves in the overlapping region 25 can take any of many forms. The transverse ribs 36 must be strong enough to withstand the anticipated tensile forces to which the geotextile tube 11 will be subjected when deployed in its intended use. Some examples of these transverse ribs 36 include sewn lines of stitching, and/or adhesive material, and/or mechanical connecters like nuts and bolts with spread collars. For example, as schematically shown in FIGS. 2 and 2*a*, a continuous sewn line of stitching 26*c* can be used as a fastener that permanently connects the two opposite narrow end sections 24*a*, 24*b* of the sheet 21 of geotextile fabric to themselves in the overlapping region 25 to form a transverse rib 36. Because this region of the stitched together overlapping region 25 that defines the transverse rib 36 binds together more than a single ply of the sheet 21 of geotextile fabric in the overlapping region 25, the transverse rib 36 has greater tensile strength than each single ply of the geotextile fabric and the warp yarns 51, 52 of same. Because of the thread used in the stitching 26*c*, this greater tensile strength also holds true for the portion of the stitching 26*c* that extends beyond the short side edges 23*a*, 23*b* that define the free edges of the two respective opposite narrow end sections 24*a*, 24*b* to combine with a single ply of the sheet 21 of geotextile fabric.

Similarly, a continuous line of adhesive material desirably can be deployed so that when applied to each ply of the geotextile material, the adhesive material permeates and infuses the geotextile material and encapsulates the fibers that form the warp and weft yarns of the geotextile material and binds the two plies of the sheet 21 of geotextile material permanently together. Once the adhesive that is applied to a defined, transversely extending region of the sheet of geotextile fabric has cured, then a transverse rib 36 forms a region of enhanced tensile strength that is so formed by the combination of the cured adhesive 26 (e.g., FIGS. 2*d*, 2*e* and 2*f*) and the overlying plies of the sheet 21 of geotextile fabric. A suitable high shear strength adhesive material suitable for this purpose is available from 3M Company of Minneapolis, Minn. and sold under the designation 3M Scotch Weld structural plastic DP820 Two-Part Acrylic Adhesive as a medium worklife adhesive having a temperature range of −67 to 250 F, a curing time of 24 to 48 hours, an application time of 15 to 20 minutes, zero percent VOC content, viscosity of 50,000 cP, specific gravity of 1.03 and Shear Strength 3100 PSI. Another suitable high shear strength adhesive material that is available from 3M Company of Minneapolis, Minn. is sold under the designation 3M Scotch Weld structural plastic DP805 Two-Part Acrylic Adhesive and is a three minute worklife adhesive having a handling strength in ten minutes.

While each transverse rib 36 desirably is shaped to extend uninterruptedly from beyond a first short side edge 23*a* through the overlapping region 25 and beyond a second short side edge 23*b* of the sheet 21 of geotextile fabric, a discontinuous line, a continuous broad area of regular geometry or irregular geometry and/or a discontinuous broad area of regular geometry or irregular geometry for the area infused with the adhesive material is also contemplated.

FIG. 2*d* schematically depicts an exaggerated, enlarged cross-sectional view taken in the direction of arrows 2*d*-2*d* in FIG. 2*c* and partially depicts one example of an embodiment of a transverse rib 36. The implementation of a transverse rib 36 that is a so-called gathered fabric rib partially shown in FIG. 2*d* is an outer portion 36*a* of a gathered section of the overlapping region 25 that has been permeated with adhesive 26 that has been cured to a solid. FIG. 2*c* schematically depicts one of the two outer portions 36*a* of a gathered fabric embodiment of a transverse rib 36 (FIG. 2*c*) that extends outside of the short side edge 23*a* of the sheet 21 of geotextile material and on one of the opposite sides of the overlapping region 25. FIG. 2*e* schematically depicts a view taken in the direction of arrows 2*e*-2*e* in FIG. 2*c* and depicts a partial cross-sectional view of an inner portion 36*b* of the gathered transverse rib 36 (FIG. 2*c*) that extends inside of both of the short side edges 23*a*, 23*b* of the sheet 21 of geotextile material and thus is disposed within the bounds defined by the opposite sides of the overlapping region 25 that are determined by the short side edges 23*a*, 23*b* of the sheet 21 of geotextile material. Moreover, the diagonal cross-hatching in each of FIGS. 2*d* and 2*e* schematically depicts the fastener 26 as adhesive material that infuses through the pores of the sheet 21 of geotextile material, encapsulates the fibers composing the warp and weft yarns of the sheet 21 of geotextile material and cures to a solid to permanently encase the gathered portions 36*a*, 36*b* of the gathered transverse rib 36 (FIG. 2*c*) into a region of the geotextile segment 20 that has a higher tensile strength than the tensile strength of the immediately adjacent portions of the sheet 21 of geotextile material composing the geotextile segment 20.

In another implementation of one of the transverse ribs 36 schematically depicted in FIG. 2*c*, a separate, relatively narrow strip 36*c* of geotextile material is inserted between the first and second narrow end sections 24*a*, 24*b* of the sheet 21 of geotextile material as schematically shown in FIG. 2*f* for example. Alternatively, the narrow strip 36*c* of geotextile material can be placed on only one of the first and second narrow end sections 24*a*, 24*b* of the sheet 21 of geotextile material so that it becomes disposed on either the inside of the hollow geotextile segment 20 or on the outside of the geotextile segment 20. Moreover, more than one narrow strip 36*c* of geotextile material can be placed in any of these locations to add strength proportional to the number of such strips 36*c* of geotextile material forming the transverse rib 36. In each case, each of the narrow strips 36*c* of geotextile material is disposed so that it elongates in a direction that traverses the overlapping region 25. As schematically shown in FIG. 2*f* the narrow strip 36*c* of geotextile material is disposed so that it elongates in a direction that desirably extends beyond each of the short side edges 23*a*, 23*b* of the sheet 21 of geotextile material and thus extends beyond and outside of the overlapping region 25. Moreover, the area outlined in a closed jagged line in FIG. 2*f* schematically depicts the fastener 26 as cured adhesive material that has infused through the pores of the three plies of the sheet 21 of geotextile material, has encapsulated the fibers composing the warp and weft yarns of the sheet 21 of geotextile material and has solidified to permanently encase the narrow strip of geotextile material 36*c* of the transverse rib 36 (FIG. 2*c*) into a region of the geotextile segment 20 that has a higher tensile strength than the tensile strength of the immediately adjacent portions of the geotextile material composing the geotextile segment 20.

As schematically depicted in FIG. 2*f*, the adhesive fastener 26 need not entirely surround each of the opposite narrower ends 36*d* of the narrow strip 36*c* of geotextile material. However, the adhesive fastener 26 desirably does completely envelope each of the respective short side edges 23*a*, 23*b* of the sheet 21 of geotextile material and thus extends beyond and outside of the extent of the overlapping region 25. Thus, the area outlined in jagged continuous line 26 schematically represents a cured adhesive that completely encapsulates the short side edges 23*a*, 23*b* of the sheet 21 and at least partially encapsulates the narrow strip 36*c*. However, complete encapsulation of the narrow strip 36*c* by the adhesive 26 also is desirable.

The amount of the cured adhesive 26 that is shown in FIGS. 2*d* and 2*e* to separate the portions of the sheet 21 of geotextile material has been exaggerated to facilitate illustration of the concept of the gathered, transverse ribs 36. In actuality, these portions of the sheet 21 would be contacting each other along most of the length of the gathered transverse rib 36.

In a typical installation of a geotextile tube 11, the empty tube 11 is stretched out on the ground lengthwise. Then through at least one of the inlet ports (not shown), which desirably is disposed near the top of the tube 11, water is pumped into the tube 11 at a pumping pressure of about one pound per square inch. Referring to FIG. 4, once the tube 11 is filled with water so that the tube 11 attains the desired height H above the supporting ground, a slurry of liquids and solids is pumped into one or more of the inlet ports (not shown). During this pumping of the liquid/solid slurry, one or more outlet ports (not shown), which desirably are located near the top of the tube 11, is/are opened to allow water to escape as the water in the tube 11 is replaced by the solids that settle to the bottom of the tube under the influence of gravity.

When the geotextile tube 11 is in use and therefore filled with solids and liquids, if the overlapping region 25 is disposed in the part of the tube 11 that rests on the ground, as on a shoreline for example, then the weight of this slurry of solid fill material and liquid fill material acts to seal the so-called axial closure 33 that is formed by the overlapping region 25 of each geotextile segment 20.

Moreover, the disposition of the elongation directions of the transverse ribs 36 need not be precisely perpendicular to the short side edges 23*a*, 23*b* of the sheet 21 as schematically represented in FIGS. 2, 2*g* and 3. And so as schematically shown in FIG. 5 for example, the disposition of the elongation directions of the transverse ribs 36 can be at angles other than ninety degrees with respect to the short side edges 23*a*, 23*b* of the sheet 21 and the longitudinal axis LA of the geotextile segment 20. However, the ninety degree disposition schematically represented in FIGS. 2, 2*g* and 3 is the presently preferred implementation for a transverse rib 36 that includes a continuous sewn line of stitching 26*c* for example.

When each geotextile segment 20 is filled with material, the forces are directed outwardly from within the geotextile segment 20 and will tend to be greatest in the circumferential direction. The forces acting from within the geotextile segment 20 will have the greatest impact on regions of the weakest tensile strength. When each geotextile segment 20 with such transverse ribs 36 as schematically depicted in FIGS. 2*c*, 2*d*, 2*e*, 2*f*, 2*g* and/or 3 for example forming the axial closure 33 as schematically depicted in FIGS. 5 and 9 for example is filled with material, the presence of the transverse ribs 36 as schematically depicted in FIG. 2*g* for example, tends to direct the forces produced by the fill material away from the transverse ribs 36, which are the regions of the greatest tensile strength. These forces tend to stretch the sheet 21 in the circumferential direction, which is the direction of elongation of the warp yarns 51 and thus where the warp yarns 51 are there to expand until the elongation at break length is exceeded.

As schematically shown in FIG. 2*g*, if the axial distance AD between the transverse ribs 36 is less than the elongation at break length of the weft yarns 52, then the geotextile segment 20 cannot stretch far enough in the axial direction to break the weft yarns 52 and cause a tear that propagates in the circumferential direction around the geotextile tube 20. Thus, with proper anticipation of the magnitude of those forces produced by the fill material acting from within the geotextile segment 20 by taking account of the amount and nature of the fill material and the size of the circumference of the geotextile segment 20, the anchoring design criteria provided by the presence of the transverse ribs 36 simplifies the task of designing the geotextile segment 20 to be able to withstand those forces by providing geotextile material with elongation at break characteristics appropriate to the job.

In alternative embodiments of a geotextile segment, the axial closure 33 can be implemented without an overlapping region 25 per se. Instead of the overlapping region 25 depicted in FIG. 3, the alternative embodiments schematically depicted in relevant part in FIGS. 3*a*, 3*b*, 3*c*, 3*d* and 3*e*, have each of the two opposite narrow end sections 24*a*, 24*b* of the sheet 21 of geotextile fabric form an axial closure 33 composed of more than two thicknesses of the sheet 21 of geotextile fabric that are permanently butted together and connected to themselves to form the hollow geotextile segment 20 into a continuous cylindrical shape having a central longitudinal axis LA (indicated by the chain-dashed line in FIG. 3). In the alternative implementations depicted schematically in FIGS. 3*a*, 3*b*, 3*c*, 3*d* and 3*e*, each of the two opposite narrow end sections 24*a*, 24*b* of the sheet 21 of geotextile fabric is folded back on itself or toward itself to form a respective axial flange 34*a*, 34*b* before being permanently connected to itself and/or to each other to form an axial rib 35. When viewed in cross-section, each of the first axial flange 34*a* and the second axial flange 34*a* of the hollow geotextile segment 20 assumes a "U-shape."

Figure 3A:
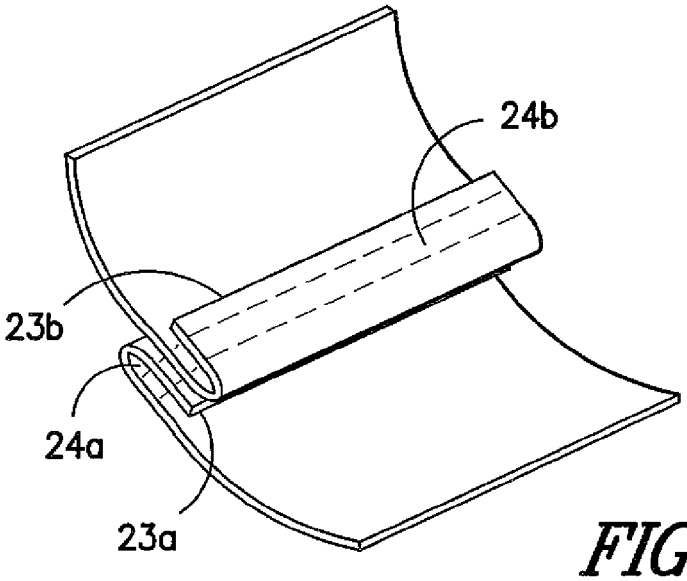
FIG. 3*a* schematically depicts in an elevated perspective view, a partial section of an embodiment of the axial closure of a cylindrical geotextile segment of a geotextile tube.
Figure 3B:
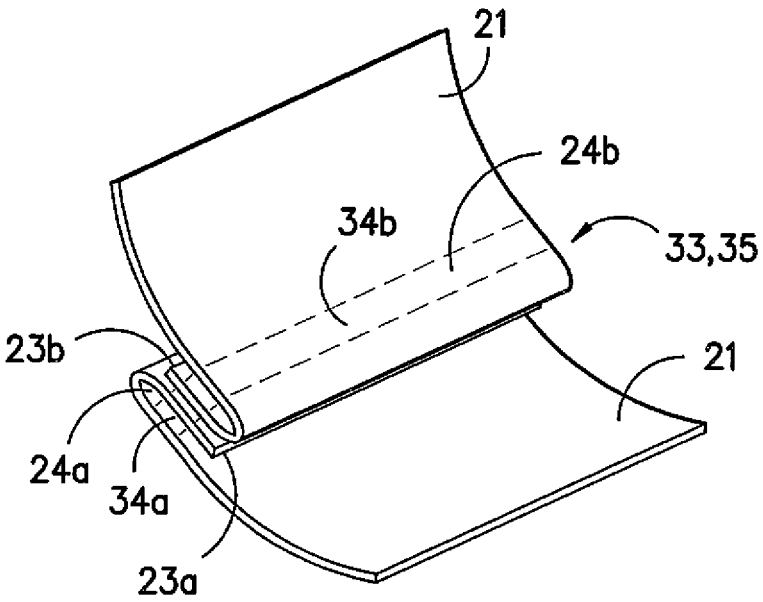
FIG. 3*b* schematically depicts in an elevated perspective view, a partial section of an embodiment of the axial closure of a cylindrical geotextile segment of a geotextile tube.
Figure 3C:
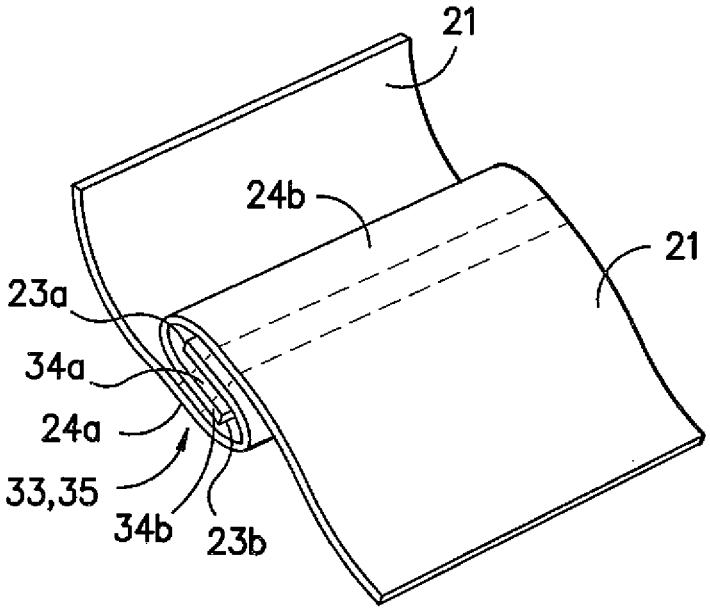
FIG. 3*c* schematically depicts in an elevated perspective view, a partial section of an embodiment of the axial closure of a cylindrical geotextile segment of a geotextile tube.
Figure 3D:
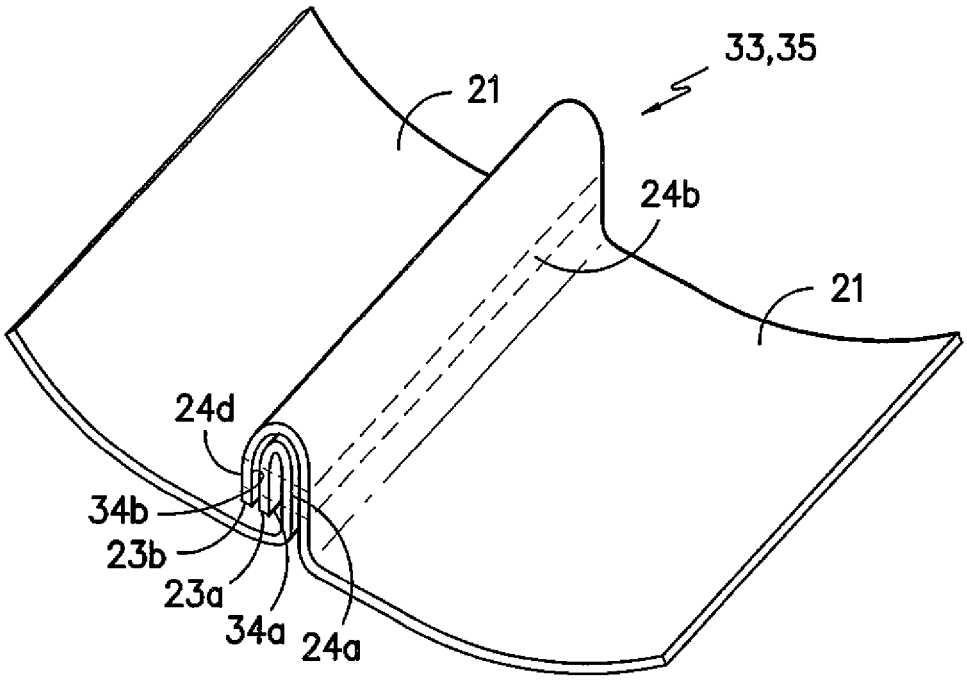
FIG. 3*d* schematically depicts in an elevated perspective view, a partial section of an embodiment of the axial closure of a cylindrical geotextile segment of a geotextile tube.
Figure 3E:
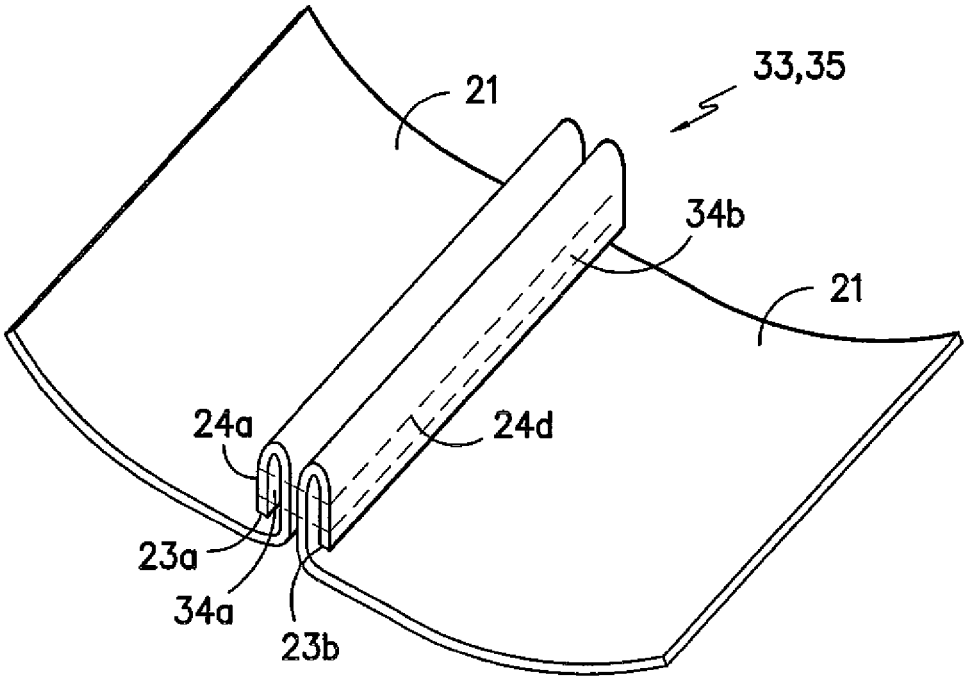
FIG. 3*e* schematically depicts in an elevated perspective view, a partial section of an embodiment of the axial closure of a cylindrical geotextile segment of a geotextile tube.

In each of the alternative implementations respectively depicted schematically in FIGS. 3*a*, 3*d* and 3*e*, the first narrow end section 24*a* of the hollow geotextile segment 20 is folded at least once inwardly toward the interior of the hollow geotextile segment 20 to form a first axial flange 34*a*, and the second narrow end section 24*b* of the hollow geotextile segment 20 is folded at least once inwardly toward the interior of the hollow geotextile segment 20 to form a second axial flange 34*b*. In the implementation depicted in FIG. 3*a*, each narrow end section 24*a*, 24*b* turns inwardly so that each respective short side edge 23*a*, 23*b* of sheet 21 points in the opposite direction. In the implementation depicted in FIG. 3*d*, each narrow end section 24*a*, 24*b* turns inwardly together in overlying and underlying fashion with respect to each other so that each respective short side edge 23*a*, 23*b* of the sheet 21 points in the same direction. In the implementation depicted in FIG. 3*e*, each narrow end section 24*a*, 24*b* turns inwardly away from the other so that each respective short side edge 23*a*, 23*b* of the sheet 21 points in the same direction. In each of these implementations, the first axial flange 34*a* of the hollow geotextile segment 20 becomes butted against the second axial flange 34*b* of that hollow geotextile segment 20 and permanently joined to the second axial flange 34*b* of that hollow geotextile segment 20 so that the axial closure 33 becomes formed into an axial rib 35 of that hollow geotextile segment 20.

Similarly, in the alternative implementation depicted schematically in FIG. 3*b*, the first narrow end section 24*a* of the hollow geotextile segment 20 is folded at least once inwardly toward the interior of the hollow geotextile segment 20 to form a first axial flange 34*a*, and the second narrow end section 24*b* of the hollow geotextile segment 20 is folded at least once outwardly toward the exterior of the hollow geotextile segment 20 to form a second axial flange 34*b*. In this way, the first axial flange 34*a* of the hollow geotextile segment 20 again becomes butted against the second axial flange 34*b* of that hollow geotextile segment 20 and permanently joined to the second axial flange 34*b* of that hollow geotextile segment 20 so that the axial closure 33 becomes formed into an axial rib 35 of that hollow geotextile segment 20.

Similarly, in the alternative implementation depicted schematically in FIG. 3*c*, the first narrow end section 24*a* of the hollow geotextile segment 20 is folded at least once inwardly toward the interior of the hollow geotextile segment 20 to form a first axial flange 34*a*, and the second narrow end section 24*b* of the hollow geotextile segment 20 is folded at least once outwardly toward the exterior of the hollow geotextile segment 20 to form a second axial flange 34*b*. One leg of each U-shaped portion of each axial flange 34*a*, 34*b* is nested into the hollow formed between the two legs of the other axial flange 34*a*, 34*b* of the hollow geotextile segment 20. In this way, the first axial flange 34*a* of the hollow geotextile segment 20 again becomes butted against the second axial flange 34*b* of that hollow geotextile segment 20 and permanently joined to the second axial flange 34*b* of that hollow geotextile segment 20 so that the axial closure 33 becomes formed into an axial rib 35 of that hollow geotextile segment 20.

The manner of permanent connection of the axial flanges 34*a*, 34*b* to each other to form the axial rib 35 that constitutes the axial closure 33 is schematically represented by the dashed parallel lines in FIGS. 3*a*, 3*b*, 3*c*, 3*d* and 3*e* and can include one or more sewn lines of stitching, and/or mechanical connecters like nuts and bolts with spread collars, and and/or adhesive material inserted between each pair of opposing faces of the two opposite narrow end sections 24*a*, 24*b* or the axial flanges 34*a*, 34*b* of the sheet 21 of geotextile fabric, as the case may be. Though each of FIGS. 3*a*, 3*b*, 3*c*, 3*d* and 3*e* depicts space between the narrow end sections 24*a*, 24*b* and/or the axial flanges 34*a*, 34*b*, each of these spaces is depicted only for purposes of having some room in the drawing for lead lines for the designating numerals, but in reality no space would exist between the adjacent plies of the sheet 21 of geotextile fabric because they would contacting against each other.

When each geotextile segment 20 with such an axial rib 35 as schematically depicted in any of FIGS. 3*a*, 3*b*, 3*c*, 3*d* and 3*e* for example forming the axial closure 33 as schematically depicted in FIG. 12 for example is filled with material, the forces acting from within the geotextile segment 20 will have the greatest impact on regions of the weakest tensile strength. By virtue of the presence of the axial rib 35 as schematically depicted in any of FIGS. 3*a*, 3*b*, 3*c*, 3*d* and 3*e* for example, the forces acting from within each the geotextile segment 20 will be directed away from the axial rib 35 in the circumferential direction, which is where the warp yarns 51 are there to expand until the elongation at break length is exceeded. The presence of the axial rib 35 effectively prevents axial expansion of the geotextile segment 20 by a distance that exceeds the elongation at break length of the sheet 21 of geotextile fabric. Thus, with proper anticipation of the magnitude of those forces acting from within the geotextile segment 20 by taking account of the amount and nature of the fill material and the size of the circumference of the geotextile segment 20, the anchoring design criteria provided by the presence of the axial rib 35 simplifies the task of designing the geotextile segment 20 to be able to withstand those forces produced by the fill material by providing geotextile material with an elongation at break rating appropriate to the job.

Various constructions of the manner of connecting adjacent hollow geotextile segments 20 to one another end-to-end to form a large scale hollow geotextile tube 11 as depicted schematically in FIG. 1 now will be described. As schematically shown with reference to FIGS. 2 and 2*c*, a first hollow geotextile segment 20-1 is depicted in a cross-sectional view with one end of a partially illustrated second hollow geotextile segment 20-2 shown attached to a first opposite end of the first hollow geotextile segment 20-1, and one end of a partially illustrated third hollow geotextile segment 20-3 is shown attached to a second opposite end of the first hollow geotextile segment 20-1. A first open end 27*a* of the first geotextile segment 20-1 is connected to the nearest first open end 27*a* of a second geotextile segment 20-2, and the second open end 27*b* of the one geotextile segment 20-1 is connected the nearest second open end 27*b* of a third geotextile segment 20-3. Though each of FIGS. 2 and 2*c* depicts a space between the ends 27*a*, 27*b* of adjacent geotextile segment 20-1 and geotextile segment 20-2 and between geotextile segment 20-1 and geotextile segment 20-3, each of these spaces is depicted only for purposes of having some room in the drawing for lead lines for the designating numerals, but in reality no space would exist between adjacent geotextile segments 20 because they would contacting against each other.

As schematically shown in FIGS. 2*b* and 2*c* for example, a first hollow geotextile segment 20-1 includes at its first open end 27*a* a first circumferential end section 28*a* of a first sheet 21 of geotextile fabric terminating in a first long side edge 22*a*. The first circumferential end section 28*a* of the first hollow geotextile segment 20-1 desirably is folded at least once by a first fold 31 that orients the first circumferential end section 28*a* at essentially a right angle with respect to the longitudinal axis LA (dashed line in FIG. 2*b*) of the first hollow geotextile segment 20-1 so that (ignoring a certain amount of bunching of the fabric as is schematically indicated by the creases 41 in FIG. 2*b*) the continuous first long side edge 22*a* lies essentially in a single plane. When oriented in this manner as shown in FIG. 2*b* for example, the first circumferential end section 28*a* of the first hollow geotextile segment 20-1 forms a first joining flange 29*a*.

As schematically shown in FIGS. 2 and 2*c* for example, a similar first fold 31 desirably orients the first circumferential end section 28*a* of the second hollow geotextile segment 20-2 at essentially a right angle with respect to the longitudinal axis (not shown) of the second hollow geotextile segment 20-2 so that the continuous first long side edge 22*a* lies essentially in a single plane and the first circumferential end section 28*a* forms an opposing first joining flange 29*a*. Though each of FIGS. 2 and 2*c* depicts a space between the opposing first joining flanges 29*a*, no space between the opposing first joining flanges 29*a*, 29*a* exists in reality because the opposing first joining flanges 29*a*, 29*a* contact against each other and are connected to one another in this manner.

In some embodiments such as shown in FIG. 2*c*, in order to connect the opposing ends of the first hollow geotextile segment 20-1 and the second hollow geotextile segment 20-2, it suffices to permanently connect these two opposing first circumferential end sections 28*a* forming the first joining flanges 29*a*, 29*a* when this connection of first joining flanges 29*a*, 29*a* will consist of only two thicknesses of the sheet 21 of geotextile fabric, one thickness from the first joining flange 29*a* of the first hollow geotextile segment 20-1 and one thickness from the first joining flange 29*a* of the second hollow geotextile segment 20-2. As schematically shown in FIG. 2*c* for example, a pair of circumferentially continuous lines of stitching 26*d* can be used to connect the first circumferential end section 28*a* of the first hollow geotextile segment 20-1 to the opposing the first circumferential end section 28*a* of the second hollow geotextile segment 20-2. Alternatively, mechanical connecters like nuts and bolts with spread collars and/or high shear strength adhesive material described above for forming the transverse ribs 36 and axial ribs 35 also is suitable for this purpose of connecting the first circumferential end section 28*a* of the first hollow geotextile segment 20-1 to the opposing the first circumferential end section 28*a* of the second hollow geotextile segment 20-2.

In some embodiments such as schematically shown in FIG. 2*c* for example, a similar connection can be made between the second open end 27*b* of the first hollow geotextile segment 20-1 and the second open end 27*b* of the third hollow geotextile segment 20-3 by similarly forming single thickness second joining flanges 29*b*, 29*b* with the two opposing second circumferential end sections 28*b*, 28*b*. As schematically shown in FIG. 2*c* for example, a pair of circumferentially continuous lines of stitching 26*d* can be used to connect the second circumferential end section 28*b* of the first hollow geotextile segment 20-1 to the opposing the second circumferential end section 28*b* of the third hollow geotextile segment 20-3.

In FIGS. 1 and 2 for example, the numeral 30 generally schematically designates each circumferential rib, and each circumferential rib desirably is schematically designated by the numeral 30 throughout the FIGS. When the opposing first joining flange portions 29*a*, 29*a* of the respective first circumferential end sections 28*a* of the first and second hollow geotextile segments 20-1, 20-2 are butted against each other and permanently connected to each other, a first circumferential rib 30 is formed. Similarly, when the opposing second joining flange portions 29*b*, 29*b* of the respective second circumferential end sections 28*b*, 28*b* of the first and third hollow geotextile segments 20-1, 20-3 are butted against each other and permanently connected, a second circumferential rib 30 is formed. A similar circumferential rib 30 desirably can be disposed and formed as the permanent connecting mechanism between each pair of adjacent ends of respective geotextile segments 20.

However, the structure that joins and permanently connects the adjacent opposing first open ends 27*a*, 27*a* of the first hollow geotextile segment 20-1 and the second hollow geotextile segment 20-2 desirably can be configured with more than two thicknesses of sheets 21 of geotextile fabric. As schematically shown in FIG. 2 for example, each respective circumferential rib 30 connecting one of the opposite ends of the first hollow geotextile segment 20-1 to an adjacent end of the second and third hollow geotextile segments 20-2, 20-3, includes at least four thicknesses of the sheet 21 of geotextile fabric, two thicknesses from the first hollow geotextile segment 20-1 and two thicknesses from the respective second and third hollow geotextile segments 20-2, 20-3. Though not illustrated, each respective circumferential rib 30 also will include the fastening structures, which could include one or more of sewn lines of stitching, and/or adhesive material, and/or mechanical connecters like nuts and bolts with spread collars.

As schematically shown in FIGS. 2 and 2*b* for example, the first circumferential end section 28*a* of the first hollow geotextile segment 20-1 desirably is folded at least a second time by a second fold 32 that is spaced apart from the first fold 31 by a length of the sheet 21 extending in the radial direction towards the axial centerline LA (FIG. 2*b*) of the first hollow geotextile segment 20-1. As schematically shown in FIG. 2*b* for example, the second fold 32 forms a 180 degree fold that first moves inwardly toward the hollow interior of the first hollow geotextile segment 20-1 and then moves back parallel to the portion of the first circumferential end section 28*a* that is disposed between the first fold 31 and the second fold 32. As schematically shown in FIGS. 2 and 2*b* for example, the second fold 32 desirably approximately bisects the first circumferential end section 28*a* of the first hollow geotextile segment 20-1. Though not shown as such, it also is contemplated that a double fold joining flange 29*a* as depicted in FIG. 2*b* could be permanently connected to a single fold joining flange 29*a* as depicted in FIG. 2*c* to form a circumferential rib 30.

As schematically shown in FIG. 2 for example, a similar second fold 32 desirably orients the first circumferential end section 28*a* of the second hollow geotextile segment 20-2 in a similar manner and so the second fold 32 is spaced apart from the first fold 31 and forms a 180 degree fold that first moves inwardly toward the hollow interior of the second hollow geotextile segment 20-2 and then moves back parallel to the portion of the first circumferential end section 28*a* that is disposed between the first fold 31 and the second fold 32. The second fold 32 desirably also approximately bisects the first circumferential end section 28*a* of the second hollow geotextile segment 20-2. When the opposing first joining flange portions 29*a* of the respective first circumferential end sections 28*a* of the first and second hollow geotextile segments 20-1, 20-2 are butted against each other and permanently connected, a first circumferential rib 30 is formed. In the embodiment schematically shown in FIG. 2, each circumferential rib 30 desirably includes at least four thicknesses of the sheet 21 of geotextile fabric, two thicknesses from the first hollow geotextile segment 20-1 and two thicknesses from the second hollow geotextile segment 20-2 and from the third hollow geotextile segment 20-3.

As schematically shown in FIG. 2 for example, the second circumferential end section 28*b* of the first hollow geotextile segment 20-1 desirably is folded at least a second time by a second fold 32 that is displaced from the first fold 31 and forms a 180 degree fold that first moves inwardly toward the hollow interior of the first hollow geotextile segment 20-1 and then moves back parallel to the portion of the second circumferential end section 28*b* that is disposed between the first fold 31 and the second fold 32. A similar second fold 32 desirably orients the second circumferential end section 28*b* of the third hollow geotextile segment 20-3 in a similar manner and so is displaced from the first fold 31 and forms a 180 degree fold that first moves inwardly toward the hollow interior of the third hollow geotextile segment 20-3 and then moves back parallel to the portion of the second circumferential end section 28*b* that is disposed between the first fold 31 and the second fold 32. When the opposing second joining flange portions 29*b* of the respective second circumferential end sections 28 of the first and third hollow geotextile segments 20-1, 20-3 are butted against each other and permanently connected, a second circumferential rib 30 is formed. A similar circumferential rib 30 desirably can be disposed between each pair of adjacent ends of respective geotextile segments 20. In the embodiment shown in FIG. 2, each circumferential rib 30 desirably includes at least four thicknesses of the sheet 21 of geotextile fabric, two thicknesses from the first hollow geotextile segment 20-1 and two thicknesses from the respective opposing second hollow geotextile segment 20-2 or third hollow geotextile segment 20-3.

As schematically shown in FIGS. 2 and 2*c* for example, a pair of circumferentially continuous lines of stitching 26*d* can be used to connect the first circumferential end section 28*a* of the first hollow geotextile segment 20-1 to the opposing the first circumferential end section 28*a* of the second hollow geotextile segment 20-2 and similarly to connect the second circumferential end section 28*b* of the first hollow geotextile segment 20-1 to the opposing the second circumferential end section 28*b* of the third hollow geotextile segment 20-3. The mechanisms by which the respective opposing circumferential end sections of adjacently disposed segments 20 are permanently connected to form the circumferentially extending ribs 30 can vary and can include various sewn stitching patterns conventional in the geotextile tube industry, and/or one or more of various high shear adhesives typically used in the geotextile tube industry, and/or mechanical connecters like nuts and bolts with spread collars.

Moreover, the number of thicknesses of the sheet of geotextile fabric 21 that can be used to form each of the circumferentially extending ribs 30 can be varied to suit the desired application for which the geotextile tube 11 is intended. A greater number of thicknesses of the sheet of geotextile fabric 21 can be used to render the ribs stiffer and thus more resistant to deformation under the stress of the pressure imposed by the heavy contents of the filled geotextile tube 11. Of course the geotextile fabric 21 composing each geotextile segment 20 will stretch when that part of the geotextile tube 11 has been filed with liquids and solids. However, as schematically shown in FIG. 5 for example, the sections of the geotextile fabric 21 stretching between the circumferential ribs 30 will tend to stretch more than will the ribs 30. The stiffer are the circumferential ribs 30 due to multiple thicknesses of the geotextile fabric 21, then the more likely is there to occur a tendency of the circumferential rib 30 to lift off the underlying supporting surface 40 and thus leave a gap 50 between the circumferential rib 30 and the underlying supporting surface 40.

This same constricting tendency of the circumferential ribs 30 produces the desirable effect of permitting the geotextile tube 11 of the present invention to assume a larger height-to-width ratio (HAW) schematically shown in FIG. 4 for example, than in conventional geotextile tube configurations. Indeed, height-to-width ratios on the order of the golden ratio of one unit of height to 1.618 units of width desirably can be achieved. Thus, when filled with solids and liquids, geotextile tubes 11 constructed in accordance with the present invention as schematically depicted in FIG. 4 have achieved sustained heights schematically denoted H in FIG. 4 that measure more than 7.5 meters. Moreover, it is believed that when filled with solids and liquids, geotextile tubes 11 constructed in accordance with the present invention as schematically depicted in FIG. 4 can achieve sustained heights schematically denoted H in FIG. 4 that measure more than 15 meters.

As schematically depicted in FIG. 4, the height H of such a geotextile tube 11 is predicted to be 59.4 feet with the width W predicted to be 170.8 feet wherein the unit weight of the slurry filling the geotextile tube 11 is uniformly 63.7 pounds per cubic foot, the circumference of the geotextile tube is 400 feet, the cross-sectional area of the geotextile tube is 8,696.3 square feet, the pumping pressure at the top of the tube 11 is 0.1 pounds per square foot, the ultimate tensile strength of the geotextile fabric 21 in the circumferential direction (warp yarn direction of the fabric 21) is 11,302.6 pounds per foot and the ultimate tensile strength of the geotextile fabric 21 in the axial direction (fill yarn direction of the fabric 21) is 8,687.6 pounds per foot. In this particular predicted embodiment, the distance L as depicted in FIG. 3 for example is about two meters, which is the approximate separation between each pair of adjacent circumferential ribs 30.

One of the prohibitive challenges posed by trying to deploy a conventional geotextile tube of this very large size is the problem of transporting a geotextile tube 11 of this volume and weight of geotextile fabric from the manufacturer's plant to the place where it is to be deployed. Even if the erosion site where the geotextile tube 11 is to be installed happened to be accessible by rail or by ship, another challenge might be posed by the space available to deploy the geotextile tube 11 often being too confined to accommodate unloading of the entire geotextile tube 11 from the vessel or train cars before the geotextile tube 11 is stretched out and deployed at the erosion site.

However, with geotextile tubes 11 configured in accordance with the present invention, it is possible to overcome both of these challenges posed against deployment of conventionally constructed tubes. For a geotextile tube 11 configured in accordance with the present invention can be shipped piece-meal in one or more segments 20 one-by-one or two-by-two (FIGS. 7, 8 and 11 for example) or some other grouping of several segments 20 (FIGS. 4, 5, 9 and 10 for example) to the site where the final geotextile tube 11 is to be deployed. Once each segment 20 or grouping of segments 20 arrives at the site of deployment, that segment 20 or grouping of segments 20 can be assembled to the already deployed length of the geotextile tube 11 on site at their respective opposing joining flanges 29*a* (FIGS. 2 and 2*b*) to form the respective circumferential rib 30. Because of the modular construction of the geotextile tube 11 in accordance with the present invention, it becomes possible to transport a very large scale geotextile tube 11 to a remote site that has limited space for unloading and deployment and even if the site is located far from the manufacturing facility where the geotextile segments 20 are manufactured. Once transported to the site where the geotextile tube 11 is to be deployed, the modular characteristic of the geotextile tube 11 of the present invention enables it to be assembled at the deployment site.

As schematically shown in FIG. 1 for example, the overlapping region 25 of each given geotextile segment 20 forming the axial closure 33 of each given geotextile segment 20 is misaligned with the axial closure 33 formed by the overlapping region 25 of each adjacent geotextile segment 20 that is connected at each opposite end of said given geotextile segment 20. Thus, as schematically shown in FIGS. 1 and 2 for example, one end of the axial closure 33 of a first hollow geotextile segment 20-1 terminates at one opposite side of a first circumferential rib 30 disposed between the first geotextile segment 20-1 and a second hollow geotextile segment 20-2, and one end of the axial closure 33 of the second hollow geotextile segment 20-2 terminates at the other opposite side of the first circumferential rib 30 that joins the first and second hollow geotextile segments 20-1, 20-2. This misaligning arrangement of the axial closures 33 of adjacent geotextile segments 20 is desirable when the axial closure 33 is formed by an axial rib 35 rather than by an overlapping region 25 having transverse ribs 36 and serves to ensure that any axially propagating tear of any given geotextile segment 20 will be stopped by encountering the circumferential rib 30 that is formed by the joined circumferential end sections 28*a*, 28*b* of adjacent geotextile segments 20.

In some applications, it may be deemed acceptable to stagger the misalignment of the axial closures 33 with respect to every two adjacent geotextile segments 20 or some other number of adjacent geotextile segments 20. But all other parameters being equal, the strongest and most tear resistant construction is a construction resembling that depicted in FIGS. 1 and 4-11 insofar as no two adjacent geotextile segments 20 have any continuous alignment between their axial closures 33.

Figure 7:
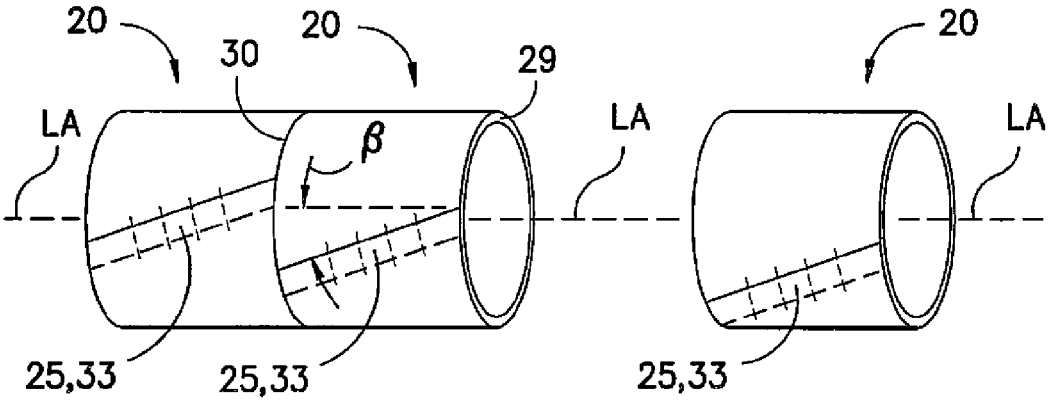
FIG. 7 schematically depicts in an elevated perspective view, three geotextile segments being constructed into an embodiment of a geotextile tube in which the axial closure of each segment elongates between the circumferential ribs in a direction that is disposed at other than a right angle with respect to the central longitudinal axis of each segment, and the end seams joining adjacent segments to form each circumferential rib are disposed at a right angle with respect to the central longitudinal axis of each segment.

However, as schematically shown in FIG. 12 for example, the presence of the circumferential ribs 30 that result from the modular construction of the geotextile tubes 11 of the present invention also makes feasible a construction in which the cumulative overall shape that is formed by the successive axial closures 33 of the geotextile segments 20 is in fact continuous and in the case of the FIG. 12 embodiment, helical in overall shape. In the FIG. 12 embodiment, the axial closures 33 can be implemented by quadruple thicknesses of the sheet 21 of geotextile material to form axial ribs 35 as schematically depicted in FIGS. 3*a*, 3*b*, 3*c*, 3*d* and 3*e* for example. Thus, instead of misaligning the orientations of the axial closures 33 as is depicted in FIG. 7 for example, the axial closures 33 of each pair of adjacent geotextile segments 20 is aligned with one another to give the appearance of a continuous axially extending closure of the geotextile tube 11. However, in reality, the presence of the circumferential ribs 30 precludes any continuity of the axially extending closures 33 of the individual geotextile segments 20 that form the geotextile tube 11.

As schematically shown in FIG. 12, a first end 33*a* of the axial closure 33 of the first hollow geotextile segment 20-1 terminates at one opposite side of the first circumferential rib 30-1 disposed between the first hollow geotextile segment 20-1 and the second hollow geotextile segment 20-2. A first end 33*a* of the axial closure 33 of the second hollow geotextile segment 20-2 terminates at the other opposite side of the first circumferential rib 30-1. Moreover, in the embodiment schematically shown in FIG. 12, the first end 33*a* of the axial closure 33 of the second hollow geotextile segment 20-2 terminates at the same circumferential location of the first circumferential rib 30-1 as the first end 33*a* of the axial closure 33 of the first hollow geotextile segment 20-1. Accordingly, the two aforementioned axial closures 33 define a helical shape that is continuous except for the interruption provided by the first circumferential rib 30-1 that separates the respective nearest ends 33*a* of the axial closures 33 of the first and second hollow geotextile segments 20-1, 20-2.

FIG. 4 schematically depicts in an elevated perspective view looking into the open end of an embodiment of a geotextile tube 11 including a plurality of three cylindrical geotextile segments 20. As shown therein, there is misalignment of the overlapping regions 25 with respect to every pair of adjacent geotextile segments 20. Alternatively, the axial closure 33 shown in FIG. 4 could be configured as an axial rib 35 as schematically shown in FIGS. 3*a*, 3*b*, 3*c*, 3*d* and 3*e* for example. The circumferential ribs 30 formed between adjacent geotextile segments 20 desirably are disposed with the joining flanges 29 deployed in the interior of the geotextile segments 20. When the hollow interior space of the geotextile tube 11 is filled with liquids and solids, the weight of the liquids and solids will press the joining flanges 29 against the interior surfaces of the sheets 21 and thereby apply forces that counteract any tendency of the opposing joining flanges 29 to separate from one another.

FIG. 5 schematically depicts in an elevated perspective view, three connected cylindrical geotextile segments 20 composing a section of an embodiment of a geotextile tube 11 lying on a generally flat supporting surface 40. As depicted therein, the axially (or longitudinally) extending closure 33 formed by the overlapping region 25 of each geotextile segment 20 elongates in a direction that is disposed to lie parallel to the central axis LA of each geotextile segment 20, which can be deployed to assume a generally cylindrical shape. However, as depicted therein, the axial closure 33 of each geotextile segment 20 elongates between the circumferential ribs 30 in a direction that is disposed to so that it does not lie in alignment with the elongation directions of the axial closures 33 of the two adjacent geotextile segments 20. Alternatively, the axial closure 33 shown in FIG. 5 could be configured as an axial rib 35 as schematically shown in FIGS. 3*a*, 3*b*, 3*c*, 3*d* and 3*e* for example. Additionally, the circumferential ribs 30 joining adjacent geotextile segments 20 are disposed at a generally right angle with respect to the central longitudinal axis LA of each segment 20.

Figure 6:
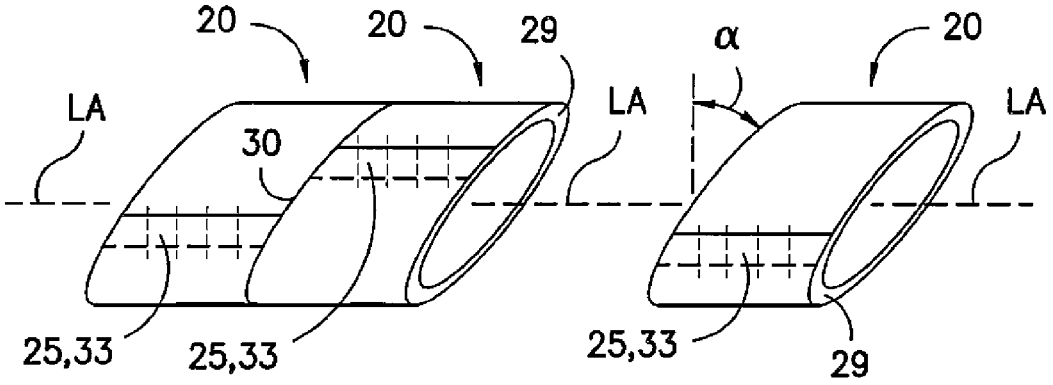
FIG. 6 schematically depicts in an elevated perspective view, three geotextile segments being constructed into an embodiment of a geotextile tube in which the axial closure of each geotextile segment elongates between the circumferential ribs in a direction that is parallel to the central longitudinal axis of each geotextile segment, and the end seams joining adjacent geotextile segments to form each circumferential rib are disposed at other than a right angle with respect to the central longitudinal axis of each geotextile segment.

FIG. 6 schematically depicts in an elevated perspective view, three segments being constructed into an embodiment of a geotextile tube. As depicted therein, the elongation direction of the axial closure 33 formed by the overlapping region 25 of each geotextile segment 20 is parallel to the central longitudinal axis LA of each geotextile segment 20. Alternatively, the axial closure 33 shown in FIG. 6 could be configured as an axial rib 35 as schematically shown in FIGS. 3*a*, 3*b*, 3*c*, 3*d* and 3*e* for example. Additionally, the circumferential rib 30 joining the two adjacent geotextile segments 20 is disposed at other than a right angle with respect to the central axis LA of each geotextile segment 20. In the FIG. 6 depiction, this angular disposition α of the circumferential rib 30 desirably is about thirty degrees off of a dashed line drawn normal to the central axis LA.

FIG. 7 schematically depicts in an elevated perspective view, three geotextile segments 20 being constructed into an embodiment of a geotextile tube 11. The elongation direction of the axial closure 33 formed by the overlapping region 25 extending between the circumferential ribs 30 of each geotextile segment 20 is disposed at other than a right angle with respect to the central longitudinal axis LA of each geotextile segment 20. In the FIG. 7 depiction, this angular disposition β of the elongation direction of the axial closure 33 formed by the overlapping region 25 is about twenty-five degrees off a dashed line drawn parallel to the central axis LA. Alternatively, the axial closure 33 shown in FIG. 7 could be configured as an axial rib 35 as schematically shown in FIGS. 3*a*, 3*b*, 3*c*, 3*d* and 3*e* for example. As schematically shown in FIG. 7, each of the end joining seams 29 that form the circumferential ribs 30 joining adjacent geotextile segments 20 and each of the circumferential ribs 30 themselves is disposed at a right angle with respect to the central longitudinal axis LA of each geotextile segment 20.

Figure 8:
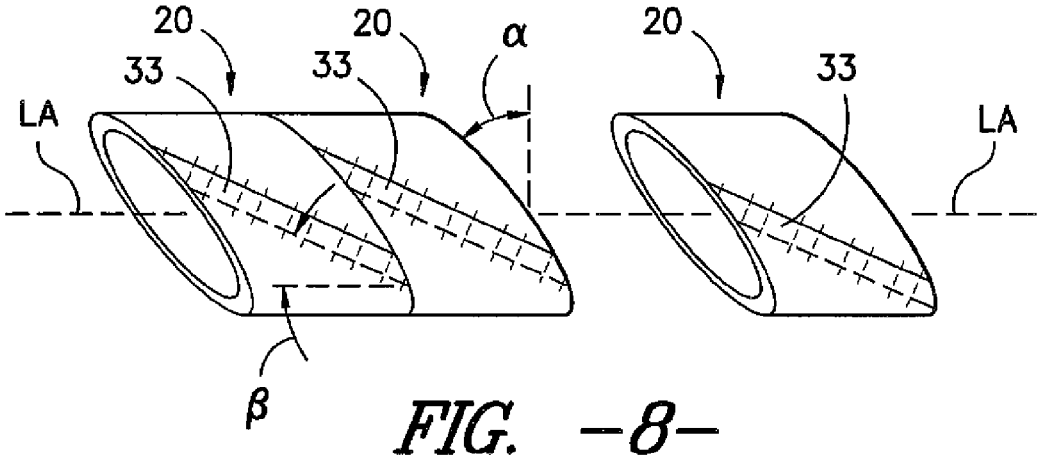
FIG. 8 schematically depicts in an elevated perspective view, three geotextile segments being constructed into an embodiment of a geotextile tube in which the axial closure of each segment elongates between the circumferential ribs in a direction that is disposed other than parallel with respect to the central longitudinal axis of each segment, and the end seams joining adjacent segments are disposed at other than a right angle with respect to a line that is normal to the central longitudinal axis of each segment.

FIG. 8 schematically depicts in an elevated perspective view, three geotextile segments 20 being constructed into an embodiment of a geotextile tube 11. As schematically shown in FIG. 8, each of the end joining seams 29 that form each of the circumferential ribs 30 joining adjacent geotextile segments 20 and each of the circumferential ribs 30 themselves is disposed at other than a right angle with respect to the central longitudinal axis LA of each geotextile segment 20. In the FIG. 8 depiction, this angular disposition α of each circumferential rib 30 of each geotextile segment is about forty-five degrees off of a dashed line drawn normal to the central axis LA. In the FIG. 8 depiction, the direction of elongation of the longer length dimension of the axial closure 33 formed by the overlapping region 25 that extends in the direction between the circumferential ribs 30 of each geotextile segment 20 is disposed at an angle that is other than parallel to the central longitudinal axis LA of each geotextile segment 20. As schematically shown in FIG. 8, this angular disposition β of the axial closure 33 formed by the overlapping region 25 is about thirty-five degrees off a dashed line drawn parallel to the central axis LA. Alternatively, the axial closure 33 shown in FIG. 8 could be configured as an axial rib 35 as schematically shown in FIGS. 3*a*, 3*b*, 3*c*, 3*d* and 3*e* for example.

FIG. 11 schematically depicts in an elevated perspective view, three geotextile segments 20 being constructed into an embodiment of a geotextile tube 11. As schematically shown in FIG. 11, each of the end joining seams 29 that form each of the circumferential ribs 30 joining adjacent geotextile segments 20 and each of the circumferential ribs 30 itself is disposed at other than a right angle with respect to the central longitudinal axis LA of each geotextile segment 20. In the FIG. 11 depiction, this angular disposition α of each circumferential rib 30 of each geotextile segment is about forty-five degrees off of a dashed line drawn normal to the central longitudinal axis LA. In the FIG. 11 depiction, the direction of elongation of the longer length dimension of the axial closure 33 formed by the overlapping region 25 that extends in the direction between the circumferential ribs 30 of each geotextile segment 20 is disposed at other than parallel to the central longitudinal axis LA of each geotextile segment 20. As schematically shown in FIG. 11, this angular disposition β of the axial closure 33 formed by the overlapping region 25 is about sixty degrees off a dashed line drawn parallel to the central axis LA. Alternatively, the axial closure 33 shown in FIG. 11 could be configured as an axial rib 35 as schematically shown in FIGS. 3*a*, 3*b*, 3*c*, 3*d* and 3*e* for example.

In general, angular dispositions of the circumferential rib 30 are useful when the geotextile tube 11 must be deployed so as to bend over or around obstructions in its path of deployment. The angular dispositions α of the circumferential rib 30 provide a relatively longer circumferential rib 30 for any given cross-sectional diameter of the geotextile tube 11, and the extra circumferential length of such relatively longer circumferential rib 30 spreads the stresses incurred at such bends over a longer distance and thus lessens the stress per unit of length of the girth of the geotextile tube 11. Similarly, the angular dispositions β of the axial closure 33 formed by the overlapping region 25 or an axial rib 35 provide a relatively longer closure for any given axial length of the geotextile segment 20, and the extra axial length spreads the stresses incurred at such axial closure 33 or axial rib 35 over a longer distance and thus lessens the stress on the axial closure 33 or axial rib 35 per unit of length of the geotextile segment 20.

FIG. 9 schematically depicts in an elevated perspective view, three connected cylindrical geotextile segments 20 composing an embodiment of a geotextile tube 11. As schematically shown in FIG. 9, each of the end joining flanges 29 that combine to form each of the circumferential ribs 30 joining adjacent geotextile segments 20 and each of the circumferential ribs 30 itself is disposed normal to the central longitudinal axis LA of each geotextile segment 20. Each axial closure 33 formed by the overlapping region 25 of each geotextile segment 20 is fastened by a least two spaced apart dual transverse ribs 36. In the FIG. 9 depiction, the direction of elongation of the longer length dimension of the axial closure 33 formed by the overlapping region 25 that extends in the direction between the circumferential ribs 30 of each geotextile segment 20 is parallel to the central axis LA of each geotextile segment 20 but not in continuous alignment with the axial closures 33 of each of the two adjacent geotextile segments 20. Alternatively, the axial closure 33 shown in FIG. 9 could be configured as an axial rib 35 as schematically shown in FIGS. 3*a*, 3*b*, 3*c*, 3*d* and 3*e* for example.

FIG. 10 schematically depicts in an elevated perspective view, three connected cylindrical geotextile segments 20 composing an embodiment of a geotextile tube 11. As schematically shown in FIG. 10, each of the end joining flanges 29 that combine to form each of the circumferential ribs 30 joining adjacent geotextile segments 20 and each of the circumferential ribs 30 itself is disposed normal to the central longitudinal axis LA of each geotextile segment 20. Each axial closure 33 formed by the overlapping region 25 of each geotextile segment 20 is fastened by a plurality of spaced apart dual transverse ribs 36, which may include gathered sections. In the FIG. 10 depiction, the direction of elongation of the longer length dimension of the axial closure 33 formed by the overlapping region 25 that extends in the direction between the circumferential ribs 30 of each geotextile segment 20 is parallel to the central axis LA of each geotextile segment 20 but not in continuous alignment with the axial closures 33 of each of the two adjacent geotextile segments 20. Alternatively, the axial closure 33 shown in FIG. 10 could be configured as an axial rib 35 as schematically shown in FIGS. 3*a*, 3*b*, 3*c*, 3*d* and 3*e* for example.

While at least one presently preferred embodiment of the invention has been described using specific terms, such description is for illustrative purposes only, and it is to be understood that changes and variations may be made without departing from the spirit or scope of the following claims. Moreover, in addition to applications for preventing soil erosion and applications for dewatering sludge, the geotextile tubes 11 formed of these geotextile segments 20 have other applications. For example, employing fabrics that are not permeable to water, these geotextile segments 20 can be used to create structures for movement of potable water over or under large bodies of water. These geotextile segments 20 can be used to provide flexible containment for the storage of contaminated materials in permanent tombs. In another example, such geotextile tubes 11 can be configured into a ring that is deployed in a body of water to act as a caisson, which is a retaining, watertight structure used, for example, to work on the foundation of a bridge pier, for the construction of a concrete dam, or for the repair of ships. These geotextile tubes 11 are constructed such that the water can be pumped out from the interior of the ring so formed, providing a working environment in the ring's interior that can be kept dry. The geotextile segments 20 possibly will be used in structures that are not permeable to water, i.e., structures such as potable water flex-barges and ocean/river barges.

What is claimed is:

1. A hollow, generally cylindrically-shaped geotextile segment for forming a geotextile tube, the geotextile segment having a circumference of at least six meters, the hollow geotextile segment comprising:

a sheet of woven geotextile fabric, the fabric being defined by a plurality of spaced apart warp yarns extending parallel to each other and a plurality of spaced apart weft yarns extending parallel to each other and normal to the warp yarns, the sheet of geotextile fabric being substantially shaped as a parallelogram that is defined by opposed long side edges that are parallel to each other and by opposed short side edges, each of the long side edges being longer in length than each of the short side edges, a first narrow end section of the sheet of geotextile fabric terminating in a first one of the short side edges, a second narrow end section of the sheet of geotextile fabric terminating in a second one of the short side edges, the first narrow end section of the sheet of geotextile fabric being overlapped on the second narrow end section of the sheet of geotextile fabric to define an overlapping region of the hollow geotextile segment and rendering the geotextile segment capable of forming a continuous cylindrical shape having a circumference thereof and having an opening at each opposite end of the geotextile segment, each of the openings being defined by a respective one of the long side edges of the sheet of geotextile fabric and having a central longitudinal axis defining the axial direction and extending through both openings, and the first narrow end section of the sheet of geotextile fabric being permanently connected to the second narrow end section of the sheet of geotextile fabric by at least one transverse rib that defines an elongated region of attachment that permanently connects the sheet of geotextile fabric to itself in the overlapping region of the first and second narrow end sections of the sheet of geotextile fabric to form an axial closure of the geotextile segment, wherein the axial closure elongates in the axial direction, wherein the at least one transverse rib elongates in a direction that is not parallel to the central longitudinal axis and so that the at least one transverse rib extends across at least one of the short side edges of one of the respective narrow end sections of the sheet of geotextile fabric, and wherein the at least one transverse rib does not extend completely around the circumference of the geotextile segment.

2. A geotextile segment as in claim 1, wherein the warp yarns extend between the short side edges and the weft yarns extend between the long side edges of the sheet of woven geotextile fabric, with the warp yarns extending in the circumferential direction and the weft yarns extending in a direction parallel to the central longitudinal axis.

3. A geotextile segment as in claim 1, wherein the circumferential extent of the at least one transverse rib being long enough to extend through the overlapping region and each of the short side edges.

4. A geotextile segment as in claim 1, wherein each of a plurality of transverse ribs permanently connects the sheet of geotextile fabric to itself in the overlapping region to form the axial closure, each transverse rib elongating in a direction that is substantially parallel to the direction of elongation of the warp yarns and substantially normal to the direction of the weft yarns, and wherein each of the plurality of transverse ribs extends across at least one of the short side edges of at least one of the respective narrow end sections of the sheet of geotextile fabric.

5. A geotextile segment as in claim 1, wherein the at least one transverse rib spaced away in the axial direction from each of the long side edges.

6. A geotextile segment as in claim 1, wherein the circumferential extent of the overlapping region being defined by a distance that is greater than 5% of the elongation at break rating distance of the sheet of geotextile fabric.

7. A geotextile segment as in claim 1, wherein each transverse rib elongates in a direction that is substantially normal to the central longitudinal axis.

8. A geotextile segment as in claim 1, wherein each of a plurality of transverse ribs permanently connects the sheet of geotextile fabric to itself in the overlapping region to form the axial closure.

9. A geotextile segment as in claim 8, wherein each transverse rib elongating in a direction that is substantially parallel to the direction of elongation of the warp yarns and substantially normal to the direction of the weft yarns.

10. A geotextile segment as in claim 7, wherein the circumferential extent of the overlapping region being defined by a distance that is greater than 5% of the elongation at break rating distance of the sheet of geotextile fabric.

11. A geotextile segment as in claim 7, wherein the circumferential extent of at least one of the transverse ribs being long enough to extend through the overlapping region and each of the short side edges.

12. A hollow geotextile segment for forming a geotextile tube, the geotextile tube having a circumference of at least six meters, the hollow geotextile segment comprising:

a sheet of geotextile fabric, the fabric being defined in part by an elongation at break rating distance, the sheet of geotextile fabric being defined by opposed long side edges disposed generally parallel to each other and by opposed short side edges disposed generally parallel to each other, each of the long side edges being longer in length than each of the short side edges, a first narrow end section of the sheet of geotextile fabric terminating in a first one of the short side edges, a second narrow end section of the sheet of geotextile fabric terminating in a second one of the short side edges, the first narrow end section of the sheet of geotextile fabric being overlapped on the second narrow end section of the sheet of geotextile fabric to define an overlapping region of the hollow geotextile segment and capable of forming a continuous cylindrical shape having a circumference thereof and having a central longitudinal axis defining an axial direction, the first narrow end section of the sheet of geotextile fabric being permanently connected to the second narrow end section of the sheet of geotextile fabric so that the sheet of geotextile fabric is permanently connected to itself in the overlapping region to form an axial closure, wherein a first open end is defined near one of the long side edges and a second open end is defined near the other one of the long side edges, and the circumferential extent of the overlapping region being defined by a distance that is greater than 5% of the elongation at break rating distance of the sheet of geotextile fabric.

13. A hollow geotextile segment as in claim 12, wherein an imaginary line connecting the shortest distance between the first open end and the second open end in the overlapping region defines the elongation direction of the axial closure, and the elongation direction of the axial closure is disposed parallel to the central longitudinal axis of the geotextile segment.

14. A hollow geotextile segment as in claim 12, wherein a first imaginary line connecting the shortest distance between the first open end and the second open end in the overlapping region defines the elongation direction of the axial closure, and the elongation direction of the axial closure is disposed at an angle that is not parallel to the central longitudinal axis of the geotextile segment.

15. A hollow geotextile segment as in claim 12, further comprising:

at least a first transverse rib disposed across the overlapping region and extending transversely across at least one of the short side edges of the sheet of geotextile fabric to connect the first narrow end section of the sheet of geotextile fabric permanently to the second narrow end section of the sheet of geotextile fabric so that the sheet of geotextile fabric is permanently connected to itself in the overlapping region to form the axial closure, and wherein the at least first transverse rib does not extend completely around the circumference of the geotextile segment.

16. A hollow geotextile segment as in claim 12, further comprising: a plurality of transverse ribs, wherein each of the plurality of transverse ribs elongates in a direction that traverses the overlapping region and extends beyond each of the short side edges of the sheet of geotextile fabric and thus extends beyond and outside of the overlapping region, and wherein each pair of transverse ribs is spaced apart in the axial direction by a distance that is at least equal to the elongation at break rating distance of the sheet of geotextile fabric.

17. A hollow geotextile segment as in claim 15, wherein the at least first transverse rib that elongates in a direction that traverses the overlapping region and extends beyond each of the short side edges of the sheet of geotextile fabric and thus extends beyond and outside of the overlapping region.

18. A hollow geotextile segment as in claim 15, wherein the at least first transverse rib includes a gathered portion of the overlapping region.

19. A hollow geotextile segment as in claim 15, wherein the at least first transverse rib includes a narrow strip of geotextile material connected to at least one of the first and second narrow end sections of the sheet of geotextile fabric.

20. A hollow geotextile segment as in claim 15, wherein:

the at least first transverse rib is formed by a line of adhesive material disposed to permanently connect the first narrow end section to the second narrow end section.

21. A hollow geotextile tube having a circumference of at least six meters, comprising:

a plurality of hollow geotextile segments, each hollow geotextile segment being defined as in claim 1, wherein a first opening of a first geotextile segment is connected to the nearest first opening of a second geotextile segment and a second opening of the first geotextile segment is connected a nearest second opening of a third geotextile segment.

22. A hollow geotextile tube as in claim 21, wherein:

the first geotextile segment defines a central longitudinal axis, and the direction of elongation of the axial closure formed in the overlapping region is disposed at an angle with respect to a direction that is parallel to the central longitudinal axis of the first geotextile segment.

23. A hollow geotextile tube as in claim 21, wherein the direction of elongation of the axial closure formed in the overlapping region of each given geotextile segment is misaligned with the direction of elongation of the axial closure formed in the overlapping region of each adjacent geotextile segment that is connected at each opposite opening of said given geotextile segment.

24. A hollow geotextile tube as in claim 21, wherein the direction of elongation of the axial closure formed in the overlapping region of each given geotextile segment is aligned with the direction of elongation of the axial closure formed in the overlapping region of each adjacent geotextile segment that is connected at each opposite end of said given geotextile segment to so that the cumulative shape formed by the successive axial closures formed in the overlapping regions of the geotextile segments is helical.

25. A hollow geotextile tube having a circumference of at least six meters, comprising:

a plurality of hollow geotextile segments, each hollow geotextile segment being defined as in claim 1, a first hollow geotextile segment defining a first circumferential end section of a first sheet of geotextile fabric terminating in a first long side edge, a second hollow geotextile segment defining a second circumferential end section of a second sheet of geotextile fabric terminating in a second long side edge, and said first circumferential end section of the first hollow geotextile segment being permanently joined to the second circumferential end section of the second hollow geotextile segment to form a first circumferential rib that is a joining seam between the first and second hollow geotextile segments and that extends completely around the circumference of the tube.

26. A hollow geotextile tube as in claim 25, wherein:

the first circumferential end section of the first hollow geotextile segment is folded at least once inwardly toward the interior of the first hollow geotextile segment to form a first joining flange, the second circumferential end section of the second hollow geotextile segment is folded at least once inwardly toward the interior of the second hollow geotextile segment to form a second joining flange, and said first joining flange of the first hollow geotextile segment being butted against the second joining flange and permanently joined to the second joining flange to form the first circumferential rib at the first joining seam between the first and second hollow geotextile segments of the hollow geotextile tube.

27. A hollow geotextile tube as in claim 26, further comprising:

a third hollow geotextile segment defining a third circumferential end section of a third sheet of geotextile fabric terminating in a third long side edge, wherein the first hollow geotextile segment defines a fourth circumferential end section of the first sheet of geotextile fabric terminating in a fourth long side edge, and said fourth circumferential end section of the first hollow geotextile segment being permanently joined to the third circumferential end section of the third hollow geotextile segment to form a second circumferential rib that is a joining seam between the first and third hollow geotextile segments and that extends completely around the circumference of the tube.

28. A hollow geotextile tube as in claim 27, wherein:

the third circumferential end section of the third hollow geotextile segment is folded at least once inwardly toward the interior of the third hollow geotextile segment to form a third joining flange, the fourth circumferential end section of the first hollow geotextile segment is folded at least once inwardly toward the interior of the first hollow geotextile segment to form a fourth joining flange, said third joining flange of the third hollow geotextile segment being butted against the fourth joining flange of the first hollow geotextile segment and permanently joined to the fourth joining flange to form the second circumferential rib of the hollow geotextile tube at the second joining seam between the first and third hollow geotextile segments.

29. A hollow geotextile tube as in claim 26, wherein:

the first geotextile segment defines a central longitudinal axis and the direction of elongation of the first circumferential rib is disposed at other than a right angle with respect to a direction that is normal to the central longitudinal axis of the first geotextile segment.

30. A hollow geotextile tube having a circumference of at least six meters, comprising:

a plurality of hollow geotextile segments, each hollow geotextile segment being capable of assuming a continuous cylindrical shape defining a circumference thereof and being defined as follows:

a sheet of geotextile fabric defined by opposed long side edges and by opposed short side edges, each of the long side edges being longer in length than each of the short side edges, a first narrow end section of the sheet of geotextile fabric terminating in a first one of the short side edges, a second narrow end section of the sheet of geotextile fabric terminating in a second one of the short side edges, the first narrow end section of the sheet of geotextile fabric being permanently connected to the second narrow end section of the sheet of geotextile fabric by at least one transverse rib that defines elongated region of attachment to form an axial closure so that the sheet of geotextile fabric is permanently connected to itself, wherein the at least one transverse rib extends across at least one of the short side edges of at least one of the respective narrow end sections of the sheet of geotextile fabric, and wherein the at least one transverse rib does not extend completely around the circumference of the geotextile segment;

a first hollow geotextile segment defining a first circumferential end section of a first sheet of geotextile fabric terminating in a first long side edge;

a second hollow geotextile segment defining a second circumferential end section of a second sheet of geotextile fabric terminating in a second long side edge;

wherein more than two thicknesses of the geotextile fabric are butted permanently together between the first circumferential end section of the first hollow geotextile segment and the second circumferential end section of the second hollow geotextile segment to form a first circumferential rib that continuously joins the first and second hollow geotextile segments around the entire circumferences of the respective first and second geotextile segments; and wherein one end of the axial closure of the first hollow geotextile segment terminates at one opposite side of the first circumferential rib disposed between the first and second hollow geotextile segments and one end of the axial closure of the second hollow geotextile segment terminates at the other opposite side of the first circumferential rib.

31. A geotextile tube as in claim 30, wherein:

a first end of the axial closure of the first hollow geotextile segment terminates at one opposite side of the first circumferential rib disposed between the first and second hollow geotextile segments and a first end of the axial closure of the second hollow geotextile segment terminates at the other opposite side of the first circumferential rib and at the same circumferential location of the first circumferential rib as the first end of the axial closure of the first hollow geotextile segment.

32. A geotextile tube as in claim 30, wherein:

a first end of the axial closure of the first hollow geotextile segment terminates at one opposite side of the first circumferential rib disposed between the first and second hollow geotextile segments and a first end of the axial closure of the second hollow geotextile segment terminates at the other opposite side of the first circumferential rib and at the same circumferential location of the circumferential rib as the first end of the axial closure of the first hollow geotextile segment and so that the two aforementioned axial closures define a helical shape that is continuous except for the interruption provided by the first circumferential rib that separates the respective nearest ends of the axial closures of the first and second hollow geotextile segments.

33. A geotextile tube as in claim 30, wherein:

the first narrow end section of each hollow geotextile segment is folded at least once back on itself to form a first axial flange, the second narrow end section of each hollow geotextile segment forms a second axial flange, and said first axial flange of each hollow geotextile segment being butted against the second axial flange of that hollow geotextile segment and permanently joined to the second axial flange of that hollow geotextile segment so that more than two thicknesses of the sheet of geotextile fabric are permanently joined together to form an axial rib of that hollow geotextile segment.

34. A geotextile tube as in claim 33, wherein:

the first narrow end section of the first hollow geotextile segment is folded at least once inwardly toward the interior of the first hollow geotextile segment to form the first axial flange, and the second narrow end section of the second hollow geotextile segment is folded at least once inwardly toward the interior of the second hollow geotextile segment to form the second axial flange.

35. A geotextile tube as in claim 33, wherein:

the first narrow end section of the first hollow geotextile segment is folded at least once inwardly toward the interior of the first hollow geotextile segment to form the first axial flange, and the second narrow end section of the second hollow geotextile segment is folded at least once outwardly toward the exterior of the second hollow geotextile segment to form the second axial flange.

36. A geotextile tube as in claim 30, wherein:

the first circumferential end section of the first hollow geotextile segment is folded at least once inwardly toward the interior of the first hollow geotextile segment to form a U-shaped, first axial flange with a pair of opposed leg portions defining a hollow between the leg portions, the second circumferential end section of the second hollow geotextile segment is folded at least once inwardly toward the interior of the second hollow geotextile segment to form a U-shaped, second axial flange with a pair of opposed leg portions defining a hollow between the leg portions, and one leg portion of the U-shaped, first axial flange of the first hollow geotextile segment is nested into the hollow formed between the two leg portions of the U-shaped, second axial flange of the second hollow geotextile segment.

* * * * *